US010837680B2

(12) United States Patent
Nishiyama et al.

(10) Patent No.: US 10,837,680 B2
(45) Date of Patent: Nov. 17, 2020

(54) REFRIGERATION CYCLE APPARATUS

(71) Applicant: Mitsubishi Electric Corporation, Tokyo (JP)

(72) Inventors: Takumi Nishiyama, Tokyo (JP); Kosuke Tanaka, Tokyo (JP); Ryota Akaiwa, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 67 days.

(21) Appl. No.: 16/328,428

(22) PCT Filed: Sep. 23, 2016

(86) PCT No.: PCT/JP2016/078058
§ 371 (c)(1),
(2) Date: Feb. 26, 2019

(87) PCT Pub. No.: WO2018/055741
PCT Pub. Date: Mar. 29, 2018

(65) Prior Publication Data

US 2019/0383526 A1 Dec. 19, 2019

(51) Int. Cl.
*F25B 13/00* (2006.01)

(52) U.S. Cl.
CPC ..... *F25B 13/00* (2013.01); *F25B 2313/0276* (2013.01)

(58) Field of Classification Search
CPC ..... F25B 13/00; F25B 2313/0276; F25B 2313/0233; F25B 2313/02332;
(Continued)

(56) References Cited

U.S. PATENT DOCUMENTS

2012/0118533 A1* 5/2012 Jang ..... F25B 41/003 165/96

FOREIGN PATENT DOCUMENTS

JP H08-170864 A 7/1996
JP H08-189724 A 7/1996
(Continued)

OTHER PUBLICATIONS

International Search Report of the International Searching Authority dated Dec. 6, 2016 for the corresponding International application No. PCT/JP2016/078058 (and English translation).

*Primary Examiner* — Elizabeth J Martin
(74) *Attorney, Agent, or Firm* — Posz Law Group, PLC

(57) ABSTRACT

A second flow path switching apparatus includes a first distribution apparatus configured to distribute refrigerant to a plurality of refrigerant paths in a first heat exchange portion, a second distribution apparatus configured to distribute refrigerant to the plurality of refrigerant paths in the first heat exchange portion and a second heat exchange portion, and a switch portion configured to switch connection of a refrigerant inlet of a first heat exchange apparatus to the first distribution apparatus or to the second distribution apparatus and switch whether refrigerant which flows out of a refrigerant outlet of the first heat exchange portion is allowed to pass through the second heat exchange portion or to merge with refrigerant which flows out of a refrigerant outlet of the second heat exchange portion in accordance with whether an order of circulation of the refrigerant is a first order (cooling) or a second order (heating).

15 Claims, 28 Drawing Sheets

(58) Field of Classification Search
CPC .. F25B 2313/02334; F25B 2313/02533; F25B 2313/02541; F25B 2313/02542; F25B 2313/02573; F25B 2313/02741; F25B 2313/02513; F25B 41/04; F25B 41/062; F25B 41/025; F25B 47/025
See application file for complete search history.

(56) References Cited

FOREIGN PATENT DOCUMENTS

| | | | |
|---|---|---|---|
| JP | 2011-220616 | A | 11/2011 |
| JP | 2015-117936 | A | 6/2015 |

* cited by examiner

| | FLOW PATH SWITCHING APPARATUS (2) | FLOW PATH SWITCHING APPARATUS (12) |
|---|---|---|
| 1. DURING COOLING | P1 → P3<br>P4 → P5<br>P6 → P2 | P11 → (4a) → P12<br>P13 → P14<br>(CONNECTION IN SERIES) |
| 2. DURING HEATING | P1 → P6<br>P5 → P3<br>P4 → P2 | P11 → (4b) → P12<br>→ P14<br>P13 → P15<br>(CONNECTION IN PARALLEL) |

<DURING COOLING>

<DURING HEATING>

WHEN THE NUMBER OF ROWS R OF HEAT EXCHANGERS IS EQUAL,
THE NUMBER OF COLUMNS C SATISFIES CONDITION OF Ca > Cb
WHEN THE NUMBER OF COLUMNS C OF HEAT EXCHANGERS IS EQUAL,
THE NUMBER OF ROWS R SATISFIES CONDITION OF Ra > Rb

<DURING COOLING>

<DURING HEATING>

<DURING COOLING>

<DURING HEATING>

FIG.35

| | COOLING | HEATING |
|---|---|---|
| OUTDOOR HEAT EXCHANGER | IN SERIES (CONDENSER) | IN PARALLEL (EVAPORATOR) |
| INDOOR HEAT EXCHANGER | IN PARALLEL (EVAPORATOR) | IN SERIES (CONDENSER) |

REFRIGERATION CYCLE APPARATUS

CROSS REFERENCE TO RELATED APPLICATION

This application is a U.S. national stage application of PCT/JP2016/078058 filed on Sep. 23, 2016, the contents of which are incorporated herein by reference.

TECHNICAL FIELD

This invention relates to a refrigeration cycle apparatus and particularly to a refrigeration cycle apparatus configured to switch a refrigerant flow path for each of cooling and heating.

BACKGROUND ART

In order to make effective use of performance of a heat exchanger and perform an operation at higher efficiency in an air conditioning apparatus, it is effective to use the heat exchanger as a condenser with the number of branches being decreased and with a flow velocity being high and to use the heat exchanger as an evaporator with the number of branches being increased and with a flow velocity being low. The reason is because, in the condenser, heat transfer dependent on a flow velocity is dominant for improvement in performance, whereas in the evaporator, decrease in pressure loss dependent on a flow velocity is dominant for improvement in performance.

With attention being paid to such characteristics of the condenser and the evaporator, for example, Japanese Patent Laying-Open No. 2015-117936 (PTL 1) has proposed an outdoor heat exchanger. In this heat exchanger, the number or a length of flow paths through which refrigerant passes can be changed by coupling of at least two unit flow paths in series or in parallel among a plurality of unit flow paths depending on whether a cooling operation or a heating operation is performed. Since the number or a length of flow paths is properly selected for use, efficiency can be improved.

A heat exchanger capable of counterflow heat exchange in both of cooling and heating in which directions of flow of refrigerant through refrigerant pipes in a heat exchanger main body are identical in functioning as a condenser and an evaporator has been known (see, for example, Japanese Patent Laying-Open No. 8-189724 (PTL 2)).

CITATION LIST

Patent Literature

PTL 1: Japanese Patent Laying-Open No. 2015-117936 (page 16 and FIGS. 4 and 5)

PTL 2: Japanese Patent Laying-Open No. 8-189724 (page 5 and FIG. 1)

SUMMARY OF INVENTION

Technical Problem

An air-conditioner described in Japanese Patent Laying-Open No. 2015-117936 is formed such that first unit flow paths and second unit flow paths are equal to each other in number during a cooling operation. When the number of the second unit flow paths is equal to the number of the first unit flow paths, a flow velocity is disadvantageously lowered and heat transferability is lowered. The reason is as follows. When it is assumed that a flow rate of refrigerant and a cross-sectional area of the flow path are constant, the flow rate in a unit flow path is expressed as flow rate [kg/s] =refrigerant density [kg/m$^3$]×flow velocity [m/s]×cross-sectional area [m$^2$]. As a density of refrigerant increases with increase in a liquid phase region in the condenser, a flow velocity of the refrigerant lowers.

In general, in an outdoor heat exchanger, during heating [evaporation], two-phase refrigerant at a low pressure flows in, and during cooling [condensation], gas refrigerant at a high pressure flows in. Since directions of flow-in are different between cooling and heating in a conventional circuit, a distribution apparatus suitable for distribution of refrigerant is provided on each inlet side (When gas flows in, influence by the gravity or inertial force is less likely, however, a density is low and hence pressure loss tends to increase. Therefore, gas is distributed by a header large in diameter. When two-phase refrigerant flows in, influence by the gravity or inertial force is likely. Therefore, by providing an element great in pipe pressure loss such as a capillary tube, influence by the gravity or inertial force is relatively lessened). In the apparatus in Japanese Patent Laying-Open No. 8-189724, however, directions of flow-in of refrigerant are the same in both of cooling and heating. With directions of flow-in of refrigerant being the same in both of a cooling operation and a heating operation, when a distribution apparatus on an inlet side is designed for flow-in of gas, influence by the gravity or inertial force is exerted at the time of flow-in of two-phase refrigerant and hence distribution will not be even. On the other hand, when gas refrigerant flows in with the distribution apparatus being designed for flow-in of two-phase refrigerant, the gas refrigerant flows through a capillary tube small in diameter. Then, pressure loss increases and performance is lowered.

The present invention was made to solve problems as above, and an object thereof is to provide a refrigeration cycle apparatus improved in heat transferability, the refrigeration cycle apparatus configured to realize a counterflow in both of cooling and heating with a flow path switching apparatus and to evenly distribute refrigerant regardless of cooling and heating.

Solution to Problem

A refrigeration cycle apparatus according to the present embodiment includes a compressor, a first heat exchange apparatus, an expansion valve, a second heat exchange apparatus, and a first flow path switching apparatus configured to change a flow path such that an order of circulation of refrigerant discharged from the compressor is switched between a first order and a second order and to switch a flow path such that refrigerant flows into a refrigerant inlet of the first heat exchange apparatus and refrigerant flows out of a refrigerant outlet of the first heat exchange apparatus when the order is either the first order or the second order. The first order is an order of circulation of refrigerant from the compressor, the first heat exchange apparatus, the expansion valve, and the second heat exchange apparatus and the second order is an order of circulation of refrigerant from the compressor, the second heat exchange apparatus, the expansion valve, and the first heat exchange apparatus. The first heat exchange apparatus includes a first heat exchange portion, a second heat exchange portion, and a second flow path switching apparatus configured to switch the flow path such that, when the order of circulation of the refrigerant is the first order, the refrigerant successively flows to the first heat exchange portion and the second heat exchange portion and when the order of circulation of the refrigerant is the second order, the refrigerant flows in parallel to the first heat exchange portion and the second heat exchange portion. The second flow path switching apparatus includes a first distribution apparatus configured to distribute refrigerant to a plurality of refrigerant flow paths in the first heat exchange portion, a second distribution apparatus configured to distribute refrigerant to the plurality of refrigerant flow paths in the first heat exchange portion and to the second heat exchange portion, and a switch portion configured to switch connection of the refrigerant inlet of the first heat exchange apparatus to the first distribution apparatus or to the second distribution apparatus and switch between passing through the second heat exchange portion, of refrigerant which flows out of the refrigerant outlet of the first heat exchange portion and merging with refrigerant which flows out of a refrigerant outlet of the second heat exchange portion in accordance with whether the order of circulation of the refrigerant is the first order or the second order.

Advantageous Effects of Invention

According to the present invention, refrigerant can evenly be distributed regardless of cooling and heating, by providing a plurality of distribution devices for cooling and heating on an inlet side of a heat exchanger.

BRIEF DESCRIPTION OF DRAWINGS

FIG. 35 is a diagram showing a state of connection during cooling and heating when an outdoor heat exchanger and an indoor heat exchanger are divided.

DESCRIPTION OF EMBODIMENTS

Figure 1:
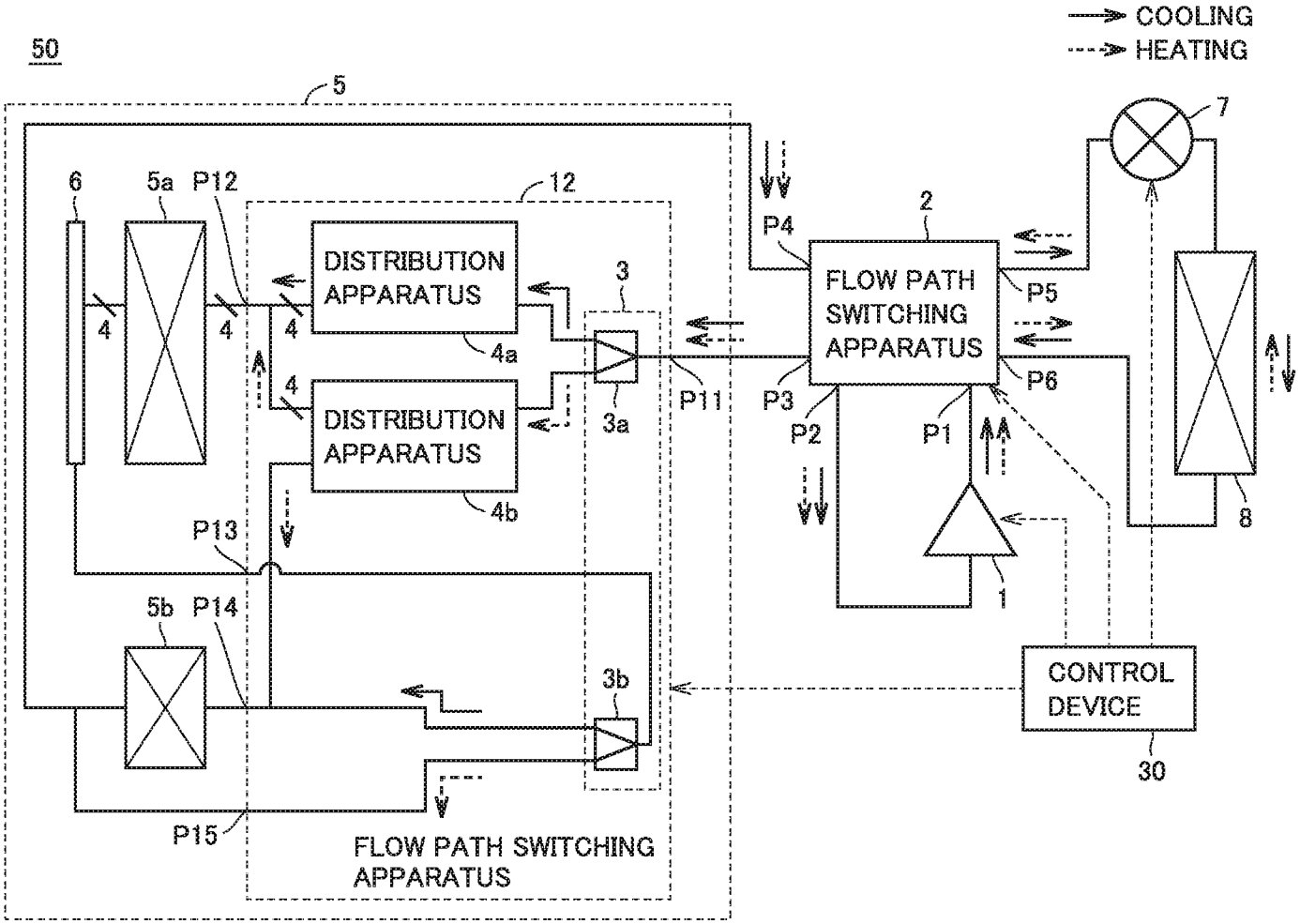
FIG. 1 is a diagram showing a construction of a refrigeration cycle apparatus according to a first embodiment.

An embodiment of the present invention will be described below in detail with reference to the drawings. In the drawings below, relation in size of each constituent member may be different from actual relation. The same or corresponding elements in the drawings below have the same reference characters allotted throughout the specification. A form of a constituent element expressed in the whole specification is merely by way of example and not limited to the description.

First Embodiment

FIG. 1 is a diagram showing a construction of a refrigeration cycle apparatus according to a first embodiment. Referring to FIG. 1, a refrigeration cycle apparatus 50 includes a compressor 1, a first heat exchange apparatus 5 (an outdoor heat exchanger), an expansion valve 7, a second heat exchange apparatus 8 (an indoor heat exchanger), and a first flow path switching apparatus 2.

First flow path switching apparatus 2 includes ports P1 to P6. Port P1 is connected to a refrigerant outlet of compressor 1 and port P2 is connected to a refrigerant inlet of compressor 1. Port P3 is connected to a refrigerant inlet of first heat exchange apparatus 5 and port P4 is connected to a refrigerant outlet of first heat exchange apparatus 5. Port P5 is connected to one end of expansion valve 7 and the other end of expansion valve 7 is connected to one end of second heat exchange apparatus 8. Second heat exchange apparatus 8 has the other end connected to port P6.

First flow path switching apparatus 2 is configured to change a flow path such that an order of circulation of refrigerant discharged from compressor 1 is switched between a first order (cooling) and a second order (heating) and to switch a flow path such that refrigerant flows into the refrigerant inlet (P3) of first heat exchange apparatus 5 and refrigerant flows out of the refrigerant outlet (P4) of first heat exchange apparatus 5 when the order is either the first order or the second order.

The first order (cooling) is an order of circulation of refrigerant from compressor 1, first heat exchange apparatus 5, expansion valve 7, and second heat exchange apparatus 8. The second order (heating) is an order of circulation of refrigerant from compressor 1, second heat exchange apparatus 8, expansion valve 7, and first heat exchange apparatus 5. Circulation of refrigerant in the first order (cooling) is also referred to as circulation of refrigerant in a first direction (cooling) below. Circulation of refrigerant in the second order (heating) is also referred to as circulation of refrigerant in a second direction (heating).

First heat exchange apparatus 5 includes a first heat exchange portion 5*a*, an outlet header 6, a second heat exchange portion 5*b*, and a second flow path switching apparatus 12. Second flow path switching apparatus 12 is configured to switch a flow path such that, when the order of circulation of refrigerant is the first order (cooling), refrigerant flows successively to first heat exchange portion 5*a* and second heat exchange portion 5*b*, and when the order of circulation of refrigerant is the second order (heating), refrigerant flows in parallel to first heat exchange portion 5*a* and second heat exchange portion 5*b*.

Second flow path switching apparatus 12 includes a first distribution apparatus 4*a* configured to distribute refrigerant to a plurality of (for example, four) refrigerant flow paths in first heat exchange portion 5*a*, a second distribution apparatus 4*b* configured to distribute refrigerant into the plurality of (for example, four) refrigerant flow paths in first heat exchange portion 5*a* and into second heat exchange portion 5*b*, and a switch portion 3. Switch portion 3 is configured to switch connection of the refrigerant inlet of first heat exchange apparatus 5 to first distribution apparatus 4*a* or to second distribution apparatus 4*b* and to switch between passing through second heat exchange portion 5*b*, of refrigerant which flows out of the refrigerant outlet of first heat exchange portion 5*a* and merging with refrigerant which flows out of a refrigerant outlet of second heat exchange portion 5*b* in accordance with whether the order of circulation of refrigerant is the first order (cooling) or the second order (heating).

An apparatus which distributes or merges refrigerant such as a distribution device, a header, or a distributor in which flat plates are layered to form flow paths can be used as being combined as appropriate as first distribution apparatus 4*a* and second distribution apparatus 4*b*.

Switch portion 3 includes a first switch valve 3*a* and a second switch valve 3*b*. First switch valve 3*a* is configured to allow refrigerant to pass to first distribution apparatus 4*a* when the order of circulation of refrigerant is the first order (cooling) and to allow refrigerant to pass to second distribution apparatus 4*b* when the order of circulation of refrigerant is the second order (heating). Second switch valve 3*b* is configured to connect the refrigerant outlet of first heat exchange portion 5*a* to a refrigerant inlet of second heat exchange portion 5*b* when the order of circulation of refrigerant is the first order (cooling) and to merge the refrigerant outlet of first heat exchange portion 5*a* with the refrigerant outlet of second heat exchange portion 5*b* when the order of circulation of refrigerant is the second order (heating).

Figures 2, 3:
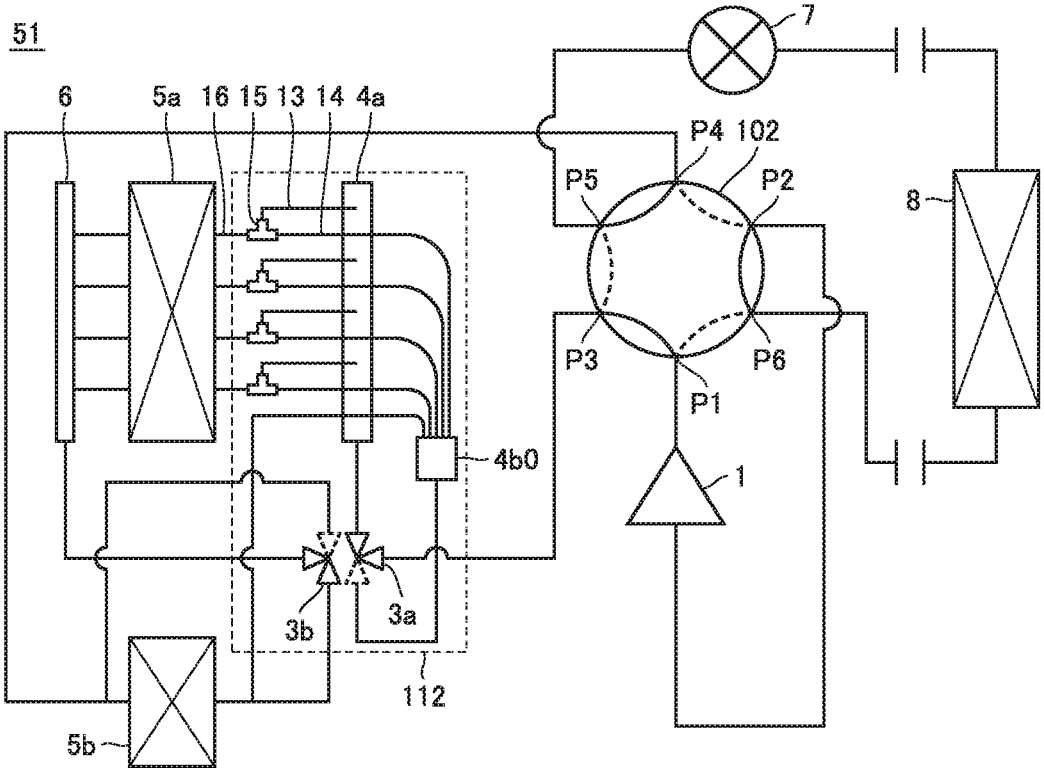
FIG. 2 is a diagram showing how a flow path switching apparatus switches a flow path in the refrigeration cycle apparatus in FIG. 1.
FIG. 3 is a diagram showing a first specific construction example of the refrigeration cycle apparatus in the first embodiment.

FIG. 2 is a diagram showing how the flow path switching apparatus switches a flow path in the refrigeration cycle apparatus in FIG. 1. A direction of circulation of refrigerant while a cooling operation is performed is shown with a solid arrow in FIG. 1. As shown in FIG. 2, a flow path is formed in flow path switching apparatus 2 such that refrigerant flows from port P1 to port P3, from port P4 to port P5, and from port P6 to port P2. A flow path is formed in flow path switching apparatus 12 such that refrigerant which has flowed into a port P11 flows out of a port P12 through distribution apparatus 4*a*, and refrigerant which has flowed into a port P13 flows out of a port P14. In this case, first heat exchange portion 5*a* and second heat exchange portion 5*b* are connected in series and refrigerant flows successively therethrough.

A direction of circulation of refrigerant while a heating operation is performed is shown with a dashed arrow in FIG. 1. As shown in FIG. 2, a flow path is formed in flow path switching apparatus 2 such that refrigerant flows from port P1 to port P6, from port P5 to port P3, and from port P4 to port P2. A flow path is formed in flow path switching apparatus 12 such that refrigerant which has flowed into port P11 is distributed to port P12 and port P14 through distribution apparatus 4*b*, and refrigerant which has flowed into port P13 flows out of port P15. In this case, first heat exchange portion 5*a* and second heat exchange portion 5*b* are connected in parallel and refrigerant flows therethrough in parallel.

In flow path switching apparatus 2 and flow path switching apparatus 12, a flow path is switched by a control signal from a control device 30.

Figure 4:
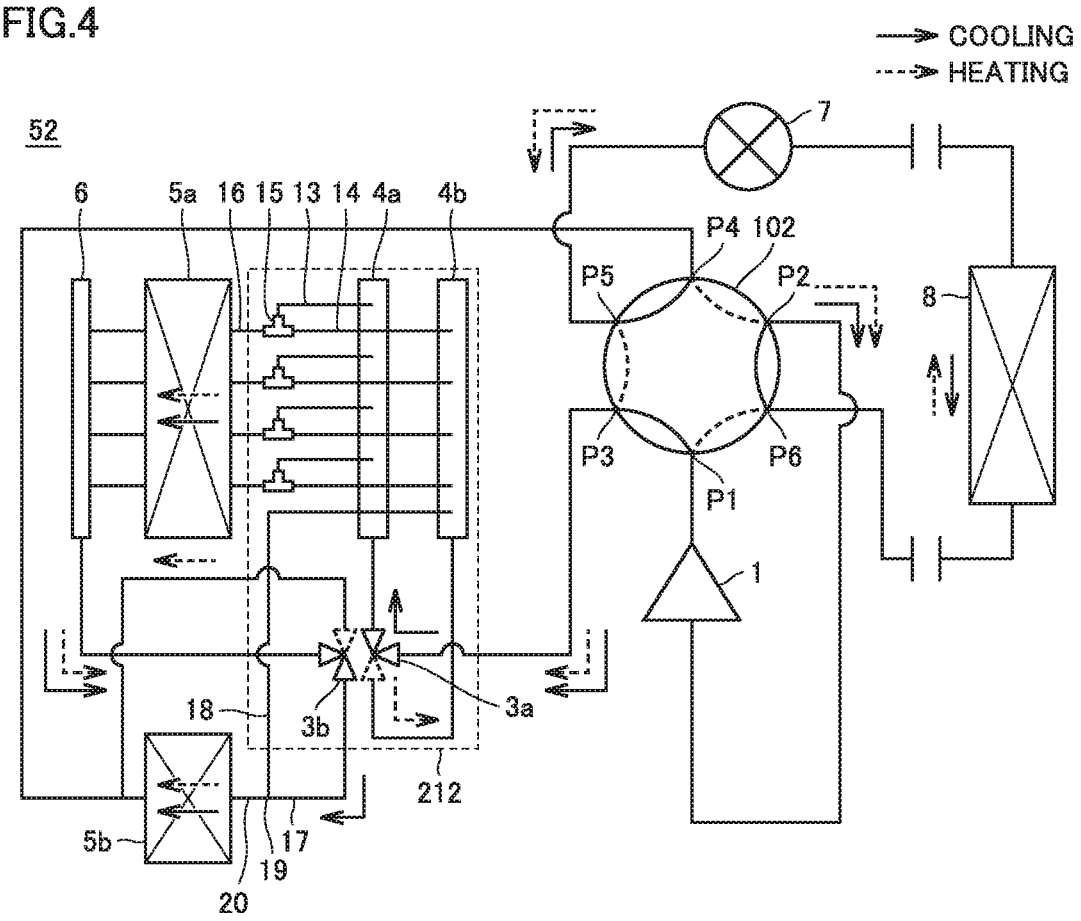
FIG. 4 is a diagram showing a second specific construction example of the refrigeration cycle apparatus in the first embodiment.

FIG. 3 is a diagram showing a first specific construction example of the refrigeration cycle apparatus in the first embodiment. FIG. 4 is a diagram showing a second specific construction example of the refrigeration cycle apparatus in the first embodiment. Referring to FIG. 3, a refrigeration cycle apparatus 51 includes a six-way valve 102 corresponding to flow path switching apparatus 2 in FIG. 1, a flow path switching apparatus 112 corresponding to flow path switching apparatus 12, compressor 1, expansion valve 7, indoor heat exchanger 8, first heat exchange portion 5*a* and second heat exchange portion 5*b*, and outlet header 6.

Flow path switching apparatus 112 includes an inlet header 4*a* configured to distribute refrigerant to a plurality of (for example, four) refrigerant flow paths in first heat exchange portion 5*a*, a distributor 4*b*0 configured to distribute refrigerant to the plurality of (for example, four) refrigerant flow paths in first heat exchange portion 5*a* and to second heat exchange portion 5*b*, and switch valves 3*a* and 3*b*.

In order to prevent the drawings from being complicated, control device 30 in FIG. 1 is not shown in FIG. 3, however, a control device which controls six-way valve 102 and switch valves 3*a* and 3*b* is similarly provided. This is also applicable to FIG. 3 and following figures.

In the construction example shown in FIG. 3, the first distribution apparatus is implemented by inlet header 4*a* and the second distribution apparatus is implemented by distributor 4*b*0. In contrast, in the construction example shown in FIG. 4, the first distribution apparatus is implemented by first inlet header 4*a* and the second distribution apparatus is implemented by a second inlet header 4*b*. A refrigeration cycle apparatus 52 shown in FIG. 4 includes a flow path switching apparatus 212 instead of flow path switching apparatus 112 in the construction of refrigeration cycle apparatus 51 shown in FIG. 3. Distributor 4*b*0 in the construction of flow path switching apparatus 112 is replaced with inlet header 4*b* in flow path switching apparatus 212. Refrigeration cycle apparatus 52 is otherwise identical in construction to refrigeration cycle apparatus 51. Operations will be described below mainly with reference to FIG. 4.

First flow path switch valve 3*a* is configured to allow refrigerant to pass through header 4*a* when a direction of circulation is the first direction (cooling) and allows refrigerant to pass through distributor 4*b*0 or inlet header 4*b* when the direction of circulation is the second direction (heating). Switch valve 3*b* is configured to connect refrigerant outlet header 6 of first heat exchange portion 5*a* to the refrigerant inlet of second heat exchange portion 5*b* when the direction of circulation is the first direction (cooling) and to merge refrigerant outlet header 6 of first heat exchange portion 5*a* to the refrigerant outlet of second heat exchange portion 5*b* when the direction of circulation is the second direction (heating).

Figure 5:
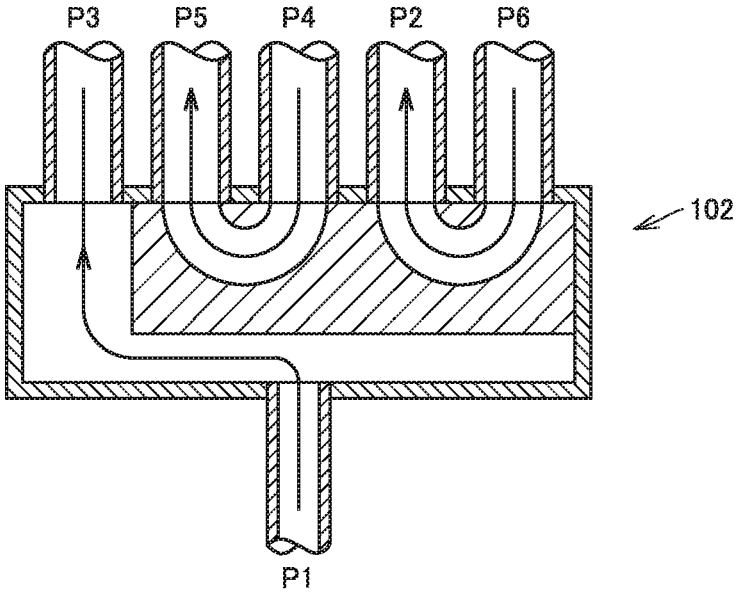
FIG. 5 is a diagram showing a flow of refrigerant during cooling in a construction example of a six-way valve 102.
Figure 6:
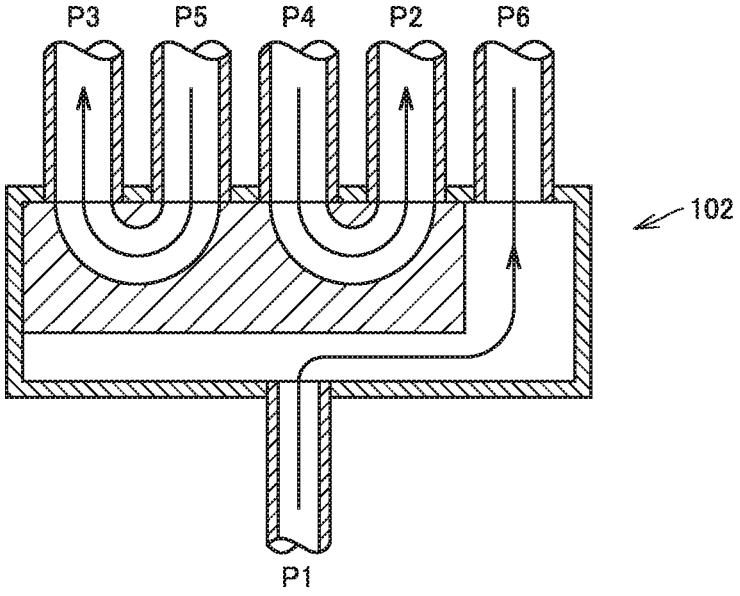
FIG. 6 is a diagram showing a flow of refrigerant during heating in the construction example of six-way valve 102.

FIG. 5 is a diagram showing a flow of refrigerant during cooling in a construction example of six-way valve 102. FIG. 6 is a diagram showing a flow of refrigerant during heating in the construction example of six-way valve 102. Six-way valve 102 includes a valve main body including a cavity therein and a slide valve disc which slides in the valve main body.

During cooling, the slide valve disc in six-way valve 102 is set to a state shown in FIG. 5. In this case, as in flow path switching apparatus 2 during cooling in FIG. 2, a flow path is formed such that refrigerant flows from port P1 to port P3, from port P4 to port P5, and from port P6 to port P2.

During heating, the slide valve disc in six-way valve 102 is set to a state shown in FIG. 6. In this case, as in flow path switching apparatus 2 during heating in FIG. 2, a flow path is formed such that refrigerant flows from port P1 to port P6, from port P5 to port P3, and from port P4 to port P2.

By switching six-way valve 102 as shown in FIGS. 5 and 6, refrigerant flows as shown with a solid arrow in FIG. 4 during the cooling operation and refrigerant flows as shown with a dashed arrow in FIG. 4 during the heating operation. By switching also switch valves 3*a* and 3*b* of flow path switching apparatus 112 in coordination with switching of six-way valve 102, relation of connection between first heat exchange portion 5*a* and second heat exchange portion 5*b* is also changed and a distribution apparatus to be used for distribution of refrigerant to the plurality of refrigerant flow paths in first heat exchange portion 5*a* is also switched.

Figure 7:
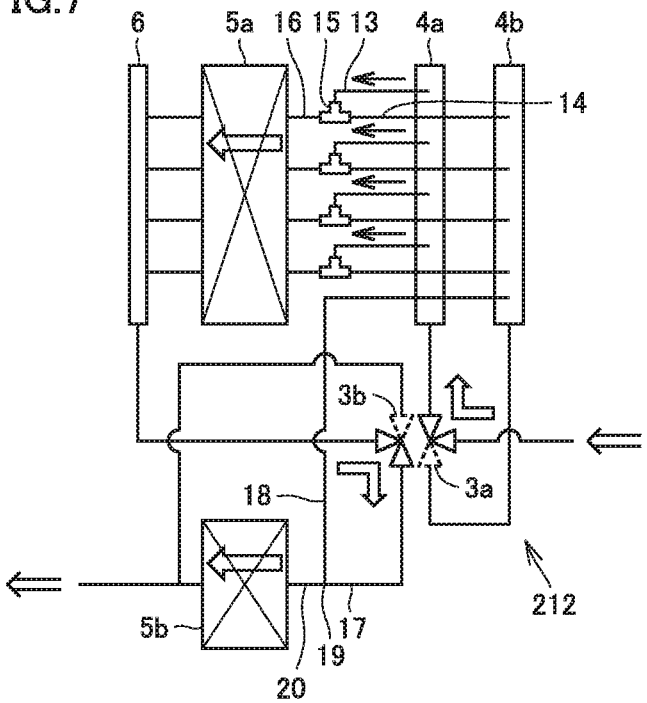
FIG. 7 is a diagram showing a flow of refrigerant in an outdoor heat exchanger during cooling.

FIG. 7 is a diagram showing a flow of refrigerant in the outdoor heat exchanger during cooling. Referring to FIGS. 4 and 7, during cooling, first flow path switch valve 3*a* is set to guide refrigerant which has flowed in from compressor 1 into flow path switching apparatus 212 to inlet header 4*a*. Since a flow path leading to inlet header 4*b* is closed, no refrigerant flows to inlet header 4*b*. Owing to first flow path switch valve 3*a*, inlet header 4*a* is used for distribution of refrigerant during cooling.

During cooling, switch valve 3*b* is set to connect first heat exchange portion 5*a* and second heat exchange portion 5*b* to each other in series. Thus, during cooling, refrigerant which has passed through first heat exchange portion 5*a* and outlet header 6 from inlet header 4*a* flows to second heat exchange portion 5*b*.

Consequently, during cooling, gas refrigerant at a high pressure and a high temperature flows from compressor 1 into flow path switching apparatus 212 and flows into first heat exchange portion 5*a* through first flow path switch valve 3*a* and first inlet header 4*a*. Refrigerant which has flowed in is condensed, flows from first heat exchange portion 5*a* through outlet header 6 and second flow path switch valve 3*b*, and is further condensed in second heat exchange portion 5*b*. Refrigerant condensed in second heat exchange portion 5*b* reaches indoor heat exchanger 8 from expansion valve 7 through six-way valve 102, evaporates therein, and returns to compressor 1 through six-way valve 102 (see the solid arrow in FIG. 4).

Figure 8:
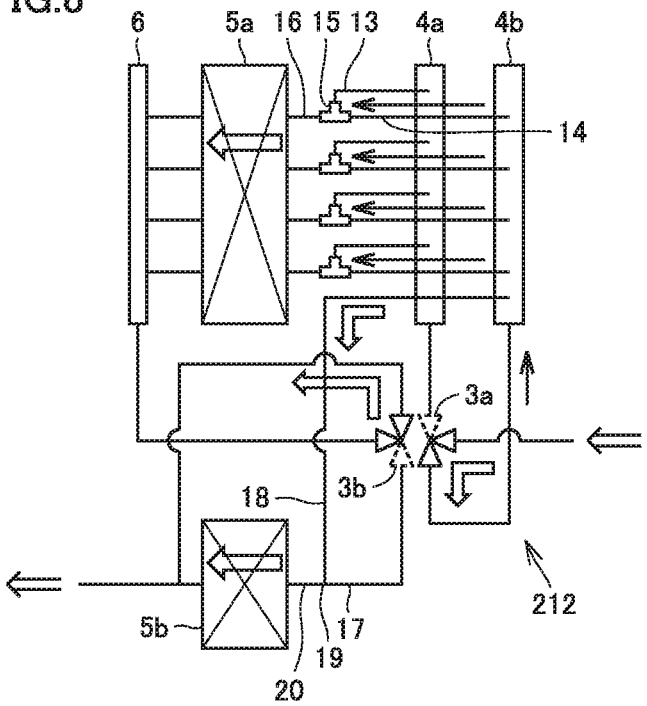
FIG. 8 is a diagram showing a flow of refrigerant in the outdoor heat exchanger during heating.

FIG. 8 is a diagram showing a flow of refrigerant in the outdoor heat exchanger during heating. Referring to FIGS. 4 and 8, during heating, first flow path switch valve 3*a* is set to guide refrigerant which has flowed from expansion valve 7 into flow path switching apparatus 212 to inlet header 4*b*. Since a flow path leading to inlet header 4*a* is closed, no refrigerant flows to inlet header 4*a*. Owing to first flow path switch valve 3*a*, inlet header 4*b* is used for distribution of refrigerant during heating.

During heating, switch valve 3*b* is set to connect first heat exchange portion 5*a* and second heat exchange portion 5*b* to each other in parallel. Thus, during heating, refrigerant distributed to first heat exchange portion 5*a* and second heat exchange portion 5*b* from inlet header 4*b* flows through first heat exchange portion 5*a* and second heat exchange portion 5*b* in parallel and thereafter refrigerant merges.

Consequently, during heating, gas refrigerant at a high temperature and a high pressure discharged from compressor 1 reaches indoor heat exchanger 8 through six-way valve 102, is condensed therein, and flows into first flow path switch valve 3*a* through expansion valve 7 and six-way valve 102. Furthermore, refrigerant flows from first flow path switch valve 3*a* through second inlet header 4*b* into first heat exchange portion 5*a* and second heat exchange portion 5*b*, and evaporates in first heat exchange portion 5*a* and second heat exchange portion 5*b*. Refrigerant which has flowed in first heat exchange portion 5*a* flows through outlet header 6 and second flow path switch valve 3*b* and merges with refrigerant which has passed through second heat exchange portion 5*b* on the exit side of second heat exchange portion 5*b*. Merged refrigerant returns to compressor 1 through six-way valve 102 (see the dashed arrow in FIG. 4).

[Construction of Each of First Heat Exchange Portion 5*a* and Second Heat Exchange Portion 5*b*]

First heat exchange portion 5*a* and second heat exchange portion 5*b* are configured to satisfy a condition of Aa>Ab, Va>Vb, and Na>Nb, where Aa and Ab, Va and Vb, and Na and Nb represent areas of heat transfer, heat exchange capacities, and the number of flow paths during cooling and heating, of first heat exchange portion 5*a* and second heat exchange portion 5*b*, respectively.

During cooling shown in FIG. 7, first heat exchange portion 5*a* and second heat exchange portion 5*b* are connected in series. In the outdoor heat exchanger as a whole, on an inlet side where gas is rich during cooling, the number of flow paths is set to Na, and on an outlet side where liquid is rich, the number of flow paths is set to Nb. The refrigerant inlet side is greater in number of flow paths than the outlet side.

During heating shown in FIG. 8, first heat exchange portion 5*a* and second heat exchange portion 5*b* are connected to each other in parallel. The number of flow paths in the outdoor heat exchanger as a whole is the sum (Na+Nb) of the number of flow paths Na in first heat exchange portion 5*a* and the number of flow paths Nb in second heat exchange portion 5*b*.

Figure 9:
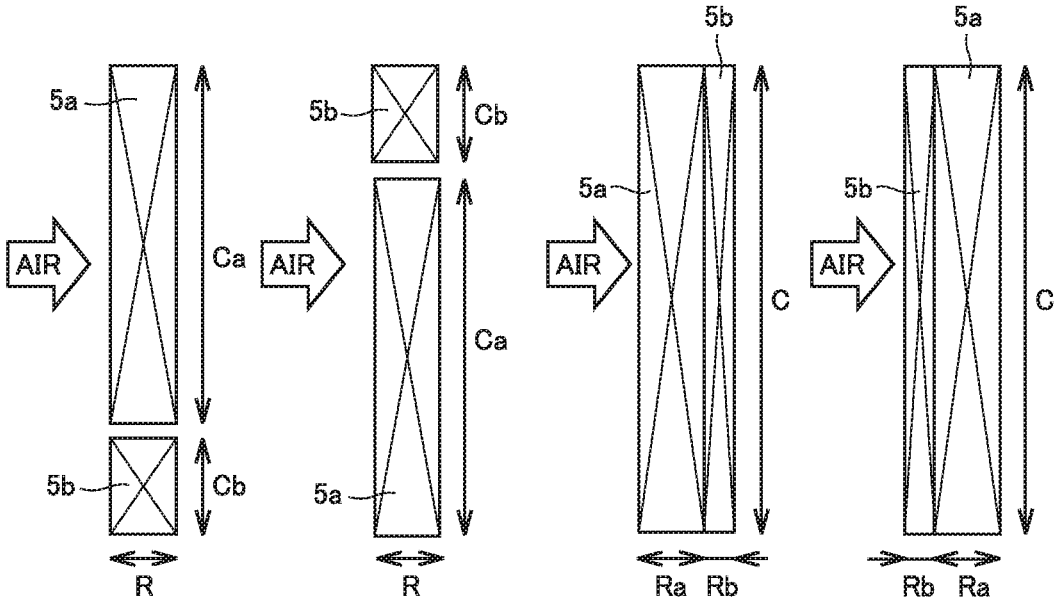
FIG. 9 is a schematic construction diagram showing arrangement of heat exchangers in a direction of column and a direction of row in the refrigeration cycle apparatus according to the first embodiment.

FIG. 9 is a schematic construction diagram showing arrangement of heat exchangers in a direction of a column and a direction of a row in the refrigeration cycle apparatus according to the first embodiment. FIG. 9 shows arrangement in a direction of the column and a direction of the row, of flow paths in each of first heat exchange portion 5*a* and heat exchange portion 5*b* shown in FIGS. 1, 3, and 4. When first heat exchange portion 5*a* and second heat exchange portion 5*b* are equivalent to each other in number of rows R, each heat exchange portion is preferably configured such that the number of columns C of heat exchangers satisfies relation of Ca>Cb where Ca represents the number of columns of first heat exchange portions 5*a* and Cb represents the number of columns of second heat exchange portions 5*b*. When first heat exchange portion 5*a* and second heat exchange portion 5*b* are equivalent in number of columns C, each heat exchange portion is preferably configured such that the number of rows R of heat exchangers satisfies relation of Ra>Rb where Ra represents the number of rows of first heat exchange portions 5*a* and Rb represents the number of rows of second heat exchange portions 5*b*.

During condensation of refrigerant, a ratio of a liquid phase increases and influence by gravity is more likely toward downstream. Therefore, the heat exchanger is preferably configured such that refrigerant flows along a direction of the gravity.

During evaporation of refrigerant, a ratio of a gas phase increases and influence by the gravity is less likely toward downstream. Therefore, refrigerant does not necessarily have to flow along the direction of the gravity, and the heat exchanger may be configured such that refrigerant flows against the direction of the gravity.

Figure 10:
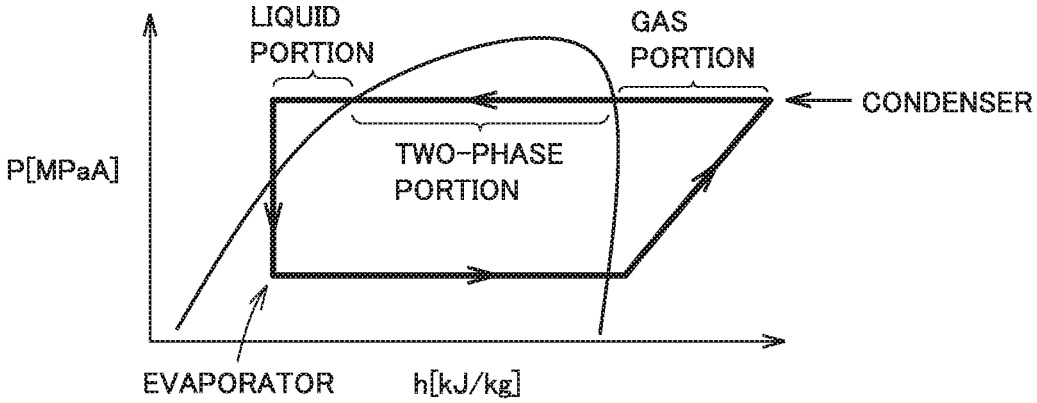
FIG. 10 is a diagram showing a P-h diagram of the refrigeration cycle apparatus.

FIG. 10 is a diagram showing a P-h diagram of the refrigeration cycle apparatus. In the refrigeration cycle apparatus in the present embodiment, a liquid portion is lower in ratio in the condenser than a gas portion and a two-phase portion. Therefore, first heat exchange portion 5*a* and second heat exchange portion 5*b* are configured to satisfy relation of Aa>Ab, Va>Vb, and Na>Nb where Aa and Ab, Va and Vb, and Na and Nb represent a heat transfer area A, a heat exchange capacity V, and the number of flow paths N of first heat exchange portion 5*a* and second heat exchange portion 5*b*, respectively. The outdoor heat exchanger is thus preferably divided such that heat of most or the entirety of the gas portion and the two-phase portion large in pressure loss is exchanged in first heat exchange portion 5*a* and most or the entirety of refrigerant which flows through second heat exchange portion 5*b* becomes a liquid phase.

Figure 11:
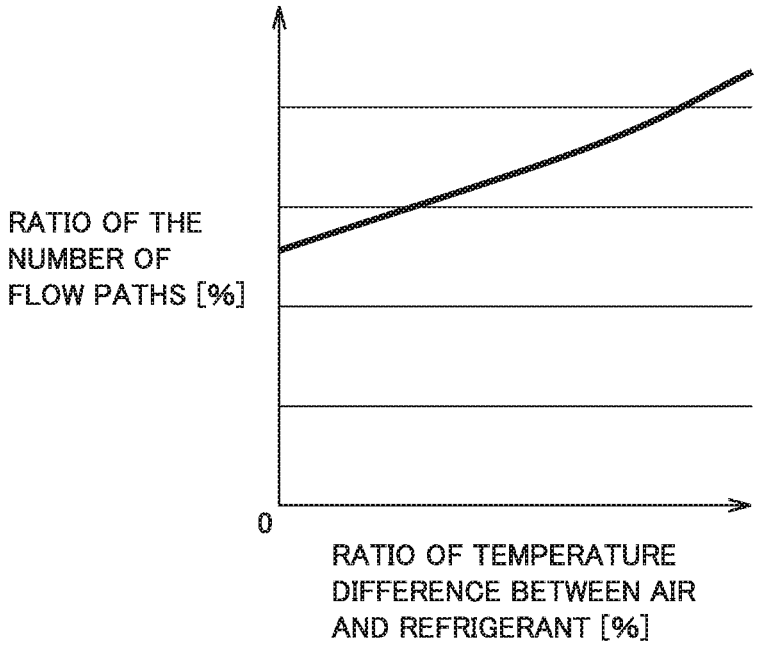
FIG. 11 is a diagram showing relation of a ratio (Nb/Na) of the number of flow paths between a first heat exchange portion 5*a* and a second heat exchange portion 5*b* with a ratio of a temperature difference between air and refrigerant in a refrigeration cycle.

FIG. 11 is a diagram showing relation of a ratio (Nb/Na) of the number of flow paths between first heat exchange portion 5*a* and second heat exchange portion 5*b* with a ratio of a temperature difference between air and refrigerant in a refrigeration cycle. As shown in FIG. 11, first heat exchange portion 5*a* and second heat exchange portion 5*b* are preferably configured such that a ratio of the number of flow paths (Nb/Na) is lower as a ratio of a temperature difference between air and refrigerant is lower.

A ratio of the number of flow paths obtained from the relation shown in FIG. 11 represents a ratio under one certain condition. In an actual heat exchanger, a ratio may slightly be modified depending on restrictions by a size of an outdoor unit, cost, distribution of a wind speed, a structure, or distribution of refrigerant.

Pressure loss is lessened by increase in density and lowering in flow velocity with increase in ratio of a liquid, and heat transferability is also lowered. Therefore, heat transferability should be improved by increasing a flow velocity while pressure loss is equivalent or less. Therefore, a ratio of the number of flow paths (Nb/Na) is at least preferably lower than 100% at any ratio of a temperature difference between air and refrigerant.

Figure 12:
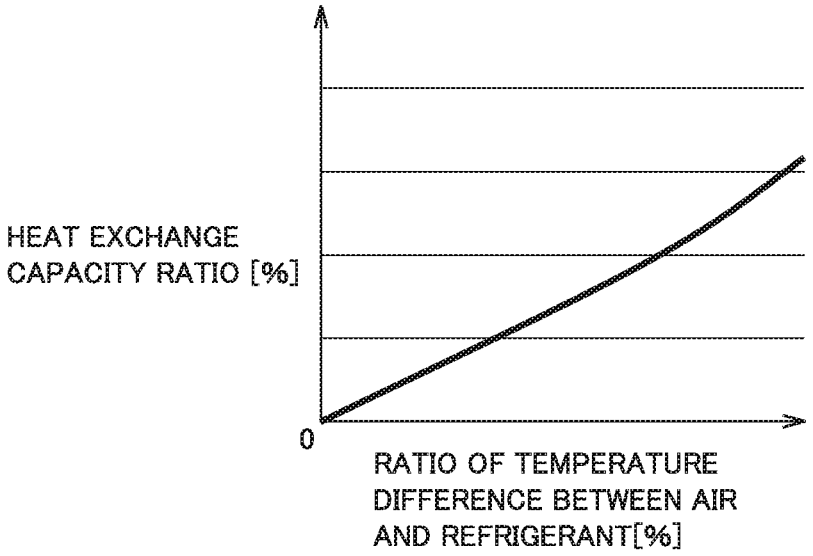
FIG. 12 is a diagram showing relation of a ratio (Vb/Va) of a heat exchange capacity between first heat exchange portion 5*a* and second heat exchange portion 5*b* with a ratio of a temperature difference between air and refrigerant in a refrigeration cycle.

FIG. 12 is a diagram showing relation of a ratio (Vb/Va) of a heat exchange capacity between first heat exchange portion 5*a* and second heat exchange portion 5*b* with a ratio of a temperature difference between air and refrigerant in a refrigeration cycle. As shown in FIG. 12, first heat exchange portion 5*a* and second heat exchange portion 5*b* are preferably configured such that a ratio of a heat exchange capacity is lower with decrease in temperature difference between air and refrigerant.

A ratio of a heat exchange capacity obtained from the relation shown in FIG. 12 represents a ratio under one certain condition. In an actual heat exchanger, a ratio may slightly be modified depending on restrictions by a size of an outdoor unit, cost, distribution of a wind speed, a structure, or distribution of refrigerant.

A ratio of a heat exchange capacity is within a range shown as 0%<ratio of heat exchange capacity<50%. A ratio of a heat exchange capacity being 0% is equivalent to absence of second heat exchange portion 5*b*, and hence a ratio of a heat exchange capacity is at least higher than 0%. When a ratio of a heat exchange capacity is not lower than 50%, first heat exchange portion 5*a* high in heat transferability in which a gas portion and a two-phase portion are produced is lower in heat exchange capacity than second heat exchange portion 5*b* and hence performance is lower.

[Construction of Distribution Apparatus at Refrigerant Inlet Portion of Outdoor Heat Exchanger]

An outdoor heat exchanger serves as an evaporator during a heating operation and two-phase refrigerant at a low pressure flows therein. During a cooling operation, the outdoor heat exchanger serves as a condenser and gas refrigerant at a high pressure flows therein. Therefore, since a state of refrigerant which flows in is different between cooling and heating in flow path switching apparatus 112 in refrigeration cycle apparatus 51 shown in FIG. 3, a distribution apparatus (header 4*a*) suitable for cooling and a distribution apparatus (distributor 4*b*0) suitable for heating are provided.

When gas refrigerant flows in (during cooling), influence by the gravity or inertial force is less likely during distribution of refrigerant, whereas refrigerant is low in density and pressure loss tends to increase. Therefore, the refrigerant is distributed by header 4*a* large in diameter. On the other hand, when two-phase refrigerant flows in (during heating), influence by the gravity or inertial force is more likely and distribution tends to be uneven. Therefore, an element high in pipe pressure loss such as distributor 4*b*0 or a capillary tube is provided so that influence by the gravity or inertial force is relatively lessened.

In the construction shown in FIG. 4, instead of distributor 4*b*0, header 4*b* is employed. Consideration as in the construction in FIG. 3 is preferably included also in this case. In flow path switching apparatus 212 in refrigeration cycle apparatus 52 shown in FIG. 4, a refrigerant pipe 13 which passes through inlet header 4*a* and a refrigerant pipe 14 which passes through inlet header 4*b* merge in a merge portion 15.

Relation of D1>D2 and L1<L2 is preferably satisfied where D1 and L1 represent a diameter and a length of pipe 13 from inlet header 4*a* to merge portion 15, respectively, and D2 and L2 represent a diameter and a length of pipe 14 from inlet header 4*b* to merge portion 15, respectively. For second heat exchange portion 5*b* as well, relation of D3>D4 and L3<L4 is preferably satisfied where D3 and L3 represent a diameter and a length of a pipe 17 from second flow path switch valve 3*b* to a merge portion 19, respectively, and D4 and L4 represent a diameter and a length of a pipe 18 from second inlet header 4*b* to merge portion 19. Pipe diameter D2 and pipe diameter D4 may be equal to each other and pipe length L2 and pipe length L4 may be equal to each other.

By thus devising a diameter and a length of the pipe, even though header 4*b* is employed as a distribution apparatus, influence by the gravity or inertial force in a two-phase refrigerant state can relatively be lessened.

Figure 13:
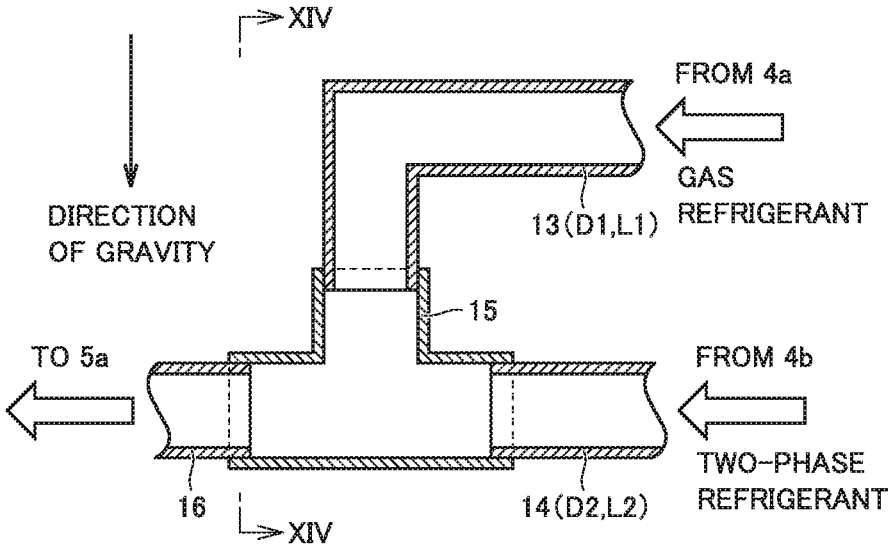
FIG. 13 is a diagram for illustrating exemplary arrangement of pipes in a merge portion in the present embodiment.
Figure 14:
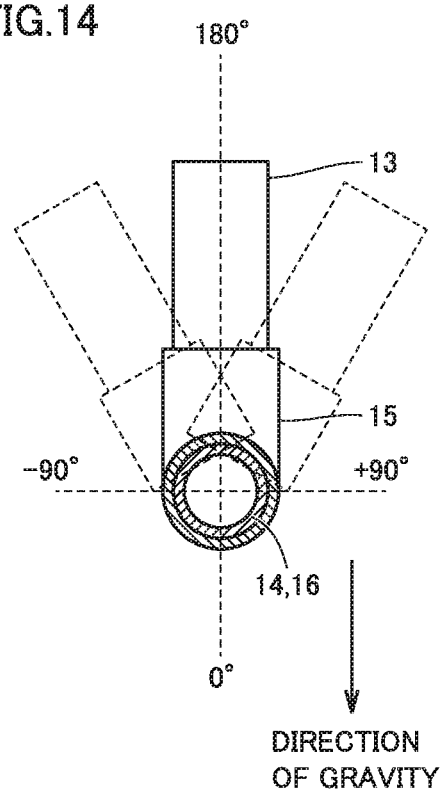
FIG. 14 is a diagram of the portion of merge of pipes shown in FIG. 13 when viewed in a XIV-XIV direction.
Figure 15:
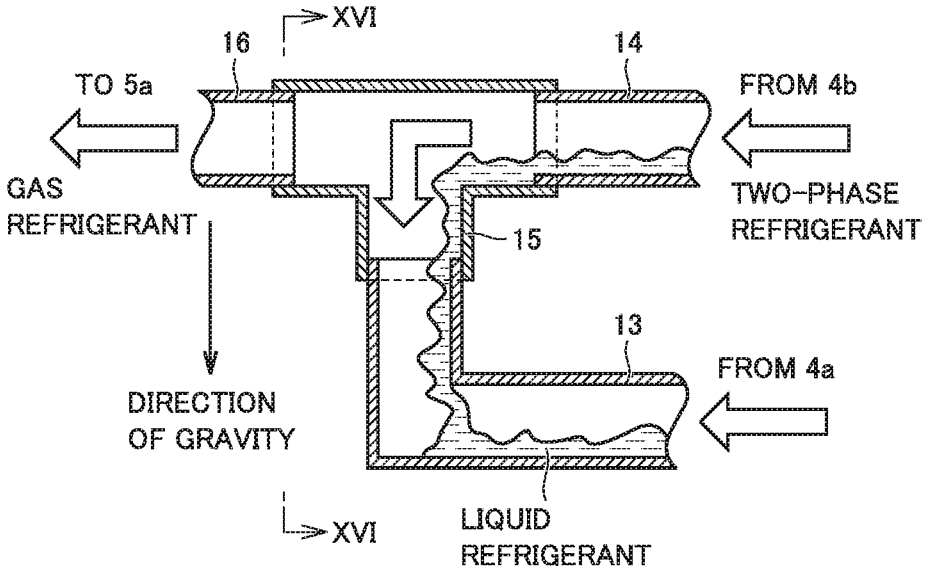
FIG. 15 is a diagram for illustrating exemplary arrangement of pipes in the merge portion in a comparative example.
Figure 16:
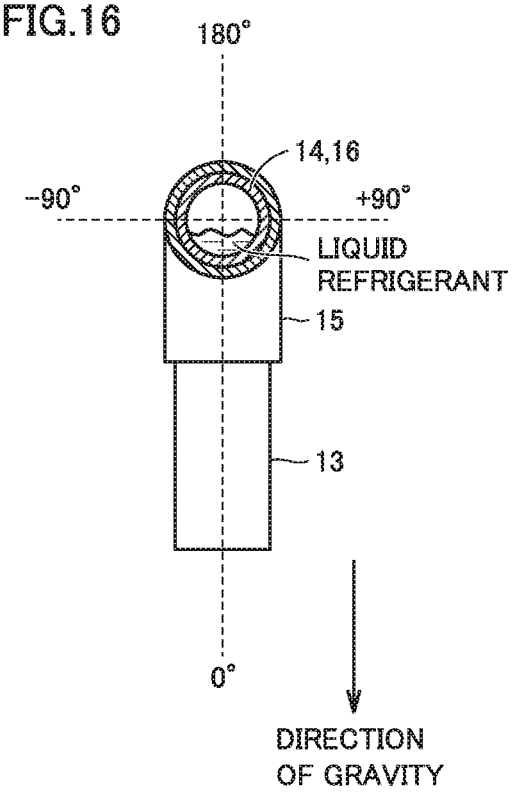
FIG. 16 is a diagram of the portion of merge of pipes shown in FIG. 15 when viewed in a XVI-XVI direction.

There is also preferred arrangement of pipes in merge portion 15. FIG. 13 is a diagram for illustrating exemplary arrangement of pipes in the merge portion in the present embodiment. FIG. 14 is a diagram of the portion of merge of the pipes shown in FIG. 13 when viewed in a XIV-XIV direction. FIG. 15 is a diagram for illustrating exemplary arrangement of pipes in the merge portion in a comparative example. FIG. 16 is a diagram of the portion of merge of the pipes shown in FIG. 15 when viewed in a XVI-XVI direction.

As in the comparative example shown in FIGS. 15 and 16, when pipe 13 is attached such that an angle of attachment of pipe 13 is at an angle the same as the direction of gravity (0°), liquid refrigerant flows into pipe 13 during flow of two-phase refrigerant from pipe 14 into heat exchange portion 5*a*, which is not preferred in terms of effective use of refrigerant.

Therefore, in the present embodiment, pipe 13 is attached such that pipe 13 is located above pipe 14 in the direction of the gravity and an angle of attachment of pipe 13 to merge portion 15 is set to $90° < \theta \leq 180°$ or $-180° \leq \theta < -90°$ as shown with a dashed line in FIG. 14 with the direction of the gravity being defined as 0°. Pipe 13 is most preferably attached such that the angle is ±180° as shown with a solid line.

Flow path switching apparatus 2 and flow path switching apparatus 12 in the first embodiment shown in FIG. 1 can variously be configured. Some construction examples are shown.

Figure 17:
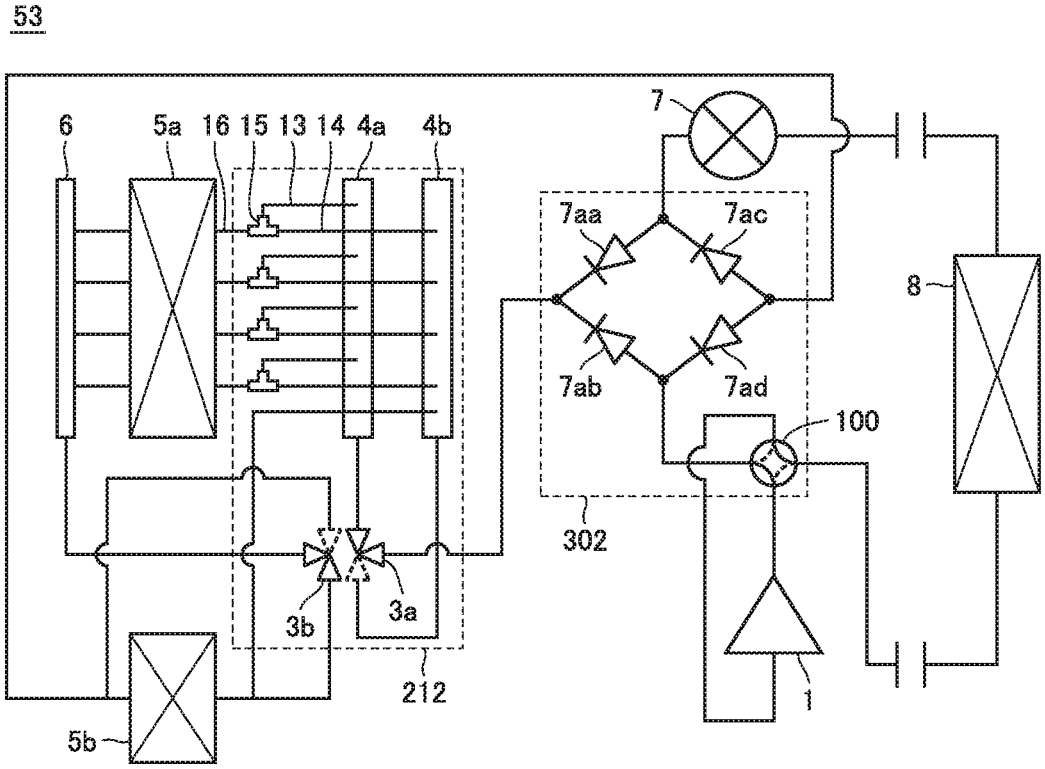
FIG. 17 is a diagram showing a first modification of the flow path switching apparatus.

FIG. 17 is a diagram showing a first modification of the flow path switching apparatus. A refrigeration cycle apparatus 53 shown in FIG. 17 includes a flow path switching apparatus 302 instead of six-way valve 102 in the construction of refrigeration cycle apparatus 52 shown in FIG. 4. Flow path switching apparatus 302 includes a four-way valve 100 and a bridge circuit including four check valves 7*aa* to 7*ad*.

Figure 18:
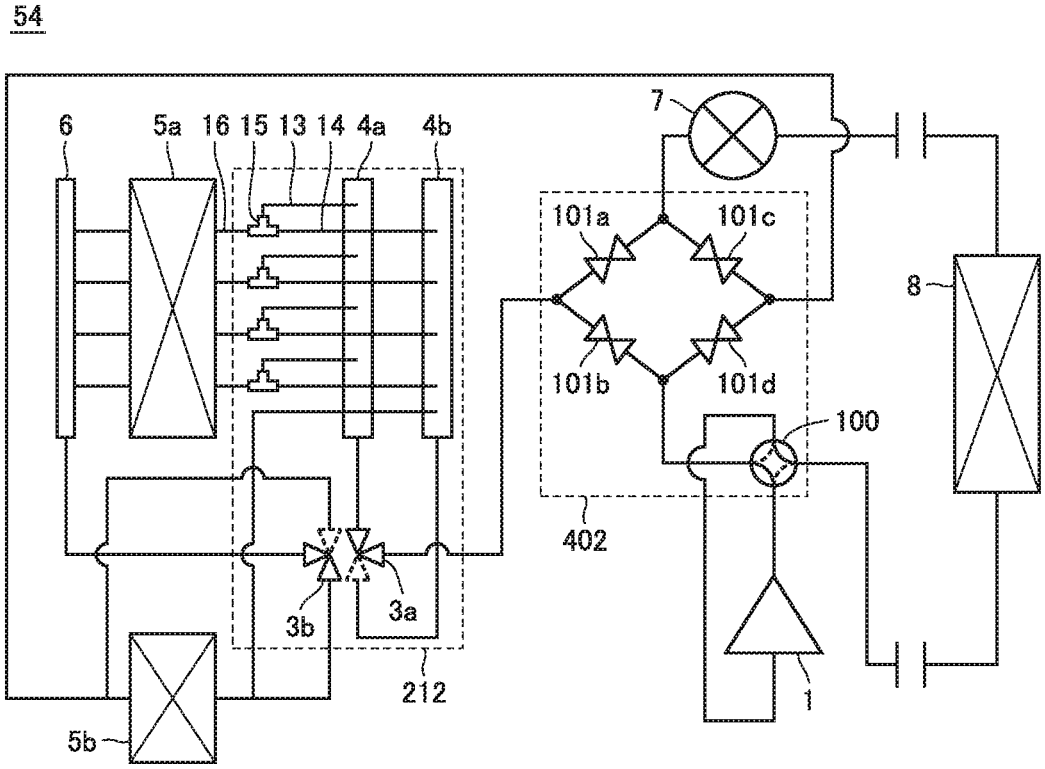
FIG. 18 is a diagram showing a second modification of the flow path switching apparatus.

FIG. 18 is a diagram showing a second modification of the flow path switching apparatus. A refrigeration cycle apparatus 54 shown in FIG. 18 includes a flow path switching apparatus 402 instead of six-way valve 102 in the construction of refrigeration cycle apparatus 52 shown in FIG. 4. Flow path switching apparatus 402 includes four-way valve 100 and a bridge circuit including four on-off valves 101*a* to 101*d*.

Figure 19:
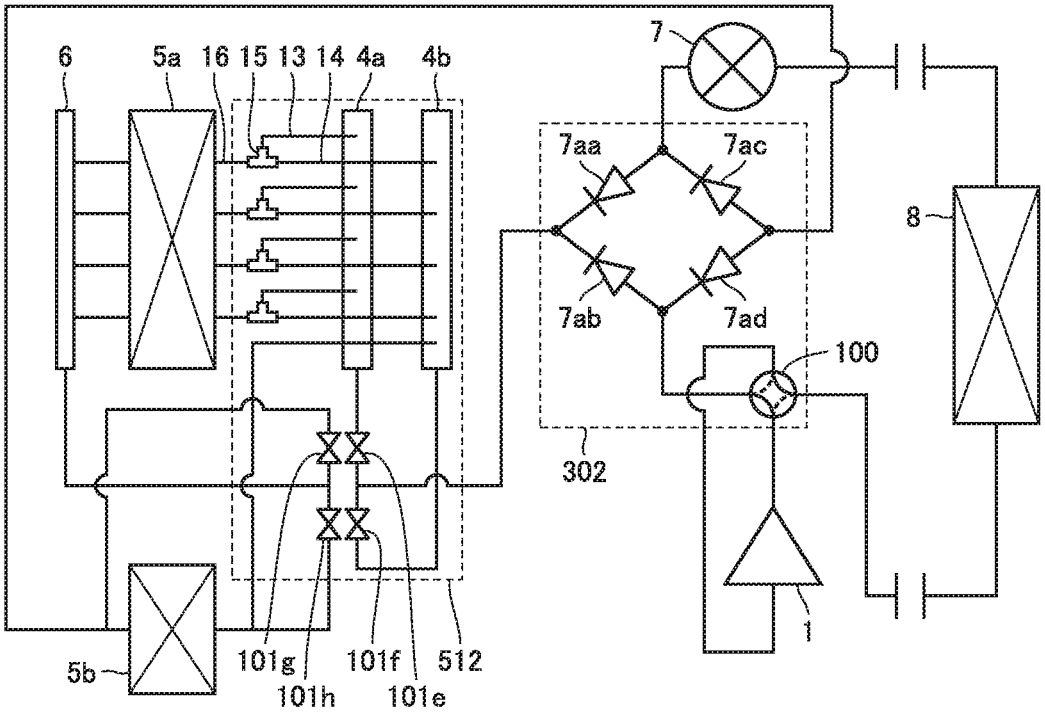
FIG. 19 is a diagram showing a third modification of the flow path switching apparatus.

FIG. 19 is a diagram showing a third modification of the flow path switching apparatus. A refrigeration cycle apparatus 55 shown in FIG. 19 includes flow path switching apparatus 302 instead of six-way valve 102 in the construction of refrigeration cycle apparatus 52 shown in FIG. 4 and includes a flow path switching apparatus 512 instead of flow path switching apparatus 212. Flow path switching apparatus 302 includes four-way valve 100 and a bridge circuit including four check valves 7*aa* to 7*ad*. Flow path switching apparatus 512 includes four on-off valves 101*e* to 101*h* in place of switch valves 3*a* and 3*b* in the construction of flow path switching apparatus 212.

Though not shown, flow path switching apparatus 402 in FIG. 18 and flow path switching apparatus 512 in FIG. 19 may be used as being combined.

Switching of a flow of refrigerant can be controlled also in the modifications as above as in the construction shown in FIG. 4.

Though an example in which first inlet header 4*a* and second inlet header 4*b* are arranged such that a longitudinal direction is defined as a vertical direction in the figures, the longitudinal direction may be arranged horizontally. Expansion valve 7 may be attached in an indoor unit.

Features above are minimal elements which enable switching of a flow of refrigerant and cooling and heating operations, and a refrigeration cycle apparatus may be formed by connection of such equipment as a gas-liquid branch device, a receiver, an accumulator, and a high-pressure or low-pressure heat exchanger.

An outdoor unit heat exchanger (first heat exchange portion 5*a* and second heat exchange portion 5*b*) and an indoor unit heat exchanger (indoor heat exchanger 8) may be implemented, for example, by any of a plate fin heat exchanger, a fin-and-tube heat exchanger, a flat tube (a multi-hole tube) heat exchanger, and a corrugated heat exchanger.

A heat exchange medium which exchanges heat with refrigerant may be water or antifreeze (for example, propylene glycol or ethylene glycol) in addition to air.

The outdoor unit heat exchanger and the indoor unit heat exchanger may be different from each other in type of the heat exchanger and in shape of a fin. For example, a flat tube may be applied to the outdoor unit heat exchanger and a fin-and-tube heat exchanger may be applied to the indoor unit heat exchanger.

Though only an example in which the outdoor unit includes first heat exchange portion 5*a* and second heat exchange portion 5*b* is described in the present embodiment, the indoor unit may include a similar circuit construction and may be formed such that the heat exchange portions are in parallel during cooling and in series during heating. Since roles of the outdoor unit and the indoor unit are interchanged between cooling and heating, connection in series and connection in parallel are also interchanged.

Though the outdoor unit heat exchanger is divided into two of first heat exchange portion 5*a* and second heat exchange portion 5*b* in the present embodiment, at least one of the indoor unit heat exchanger and the outdoor unit heat exchanger may be divided into three. For example, the construction may be modified such that a heat exchange capacity and the number of flow paths in the indoor unit heat exchanger and the outdoor unit heat exchanger are optimized for each of a gas phase, two phases, and a liquid phase.

Effects of the refrigeration cycle apparatus according to the first embodiment will now be described.

The refrigeration cycle apparatus according to the first embodiment is formed such that refrigerant flows into an outdoor unit heat exchanger in the same direction in both of cooling and heating and divided heat exchangers are connected in series during cooling (condensation) and connected in parallel during heating (evaporation). By providing a plurality of distribution apparatuses suitable for cooling and heating on the inlet side of the outdoor heat exchanger, refrigerant can evenly be distributed to a plurality of flow paths in the heat exchanger during any of cooling and heating.

Figure 20:
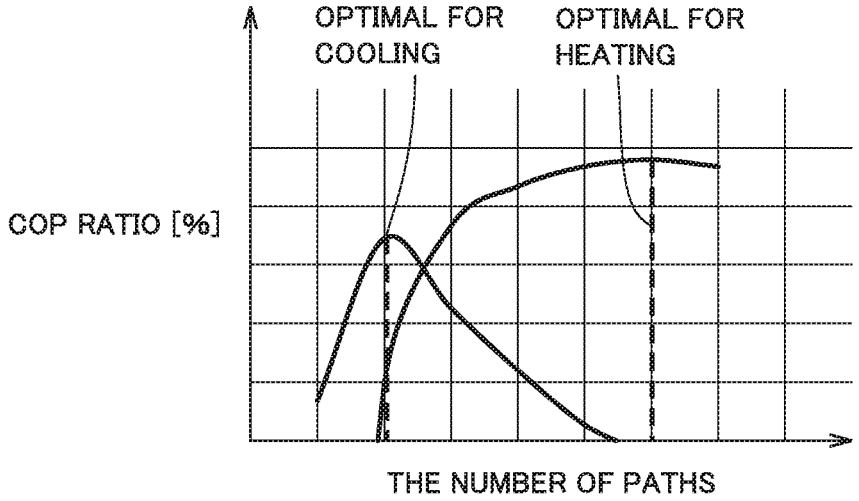
FIG. 20 is a schematic construction diagram showing a difference in peak of a COP when the number of paths is variable between cooling and heating according to the first embodiment.

FIG. 20 is a diagram showing a difference in peak of a COP when the number of paths is variable between cooling and heating according to the first embodiment. According to the refrigeration cycle apparatus according to the first embodiment, first heat exchange portion 5*a* is higher in heat exchanger capacity than second heat exchange portion 5*b*, and first heat exchange portion 5*a* is greater in number of flow paths than second heat exchange portion 5*b*. Therefore, the number of flow paths is varied to the number of flow paths (the number of paths) suitable for each of cooling and heating as shown in FIG. 20 when first heat exchange portion 5*a* and second heat exchange portion 5*b* are arranged in series during cooling and arranged in parallel during heating.

By setting an optimal number of flow paths, a coefficient of performance (COP) can be improved and an annual performance factor (APF) can be improved in each of cooling and heating.

By setting a heat exchanger capacity of first heat exchange portion 5*a* to be higher than a heat exchanger capacity of second heat exchange portion 5*b* during cooling, a ratio of a liquid phase region where a flow velocity of refrigerant which flows into second heat exchange portion 5*b* becomes lower can be increased.

By setting the number of flow paths in first heat exchange portion 5*a* to be greater than the number of flow paths in second heat exchange portion 5*b* during cooling, a flow velocity of refrigerant which flows into second heat exchange portion 5*b* can be increased.

By setting the number of flow paths and a heat exchanger capacity of first heat exchange portion 5*a* to be greater than the number of flow paths and a heat exchanger capacity of second heat exchange portion 5*b*, heat transferability can be improved in the liquid phase region where pressure loss is less while pressure loss in the gas region and the two-phase region is lessened.

In the present embodiment, a flow path is formed such that relation between diameter D1 and length L1 of pipe 13 from first inlet header 4*a* to merge portion 15 and diameter D2 and length L2 of pipe 14 from second inlet header 4*b* to merge portion 15 satisfies a condition of $D1>D2$ and $L1<L2$ and relation between diameter D3 and length L3 of pipe 17 from second flow path switch valve 3*b* to merge portion 19 and diameter D4 and length L4 of pipe 18 from second inlet header 4*b* to merge portion 19 satisfies a condition of $D3>D4$ and $L3<L4$. Pressure loss in a flow from first inlet header 4*a* to the merge portion can thus be lessened during cooling. Two-phase refrigerant can evenly be distributed while it flows from first inlet header 4*a* to the merge portion during heating (because influence by pipe pressure loss is greater than influence by the gravity).

As shown in FIGS. 13 and 14, pipe 13 is attached such that pipe 13 is located above pipe 14 in the direction of the gravity and an angle of attachment of pipe 13 to merge portion 15 is set to $90°<\theta\leq180°$ or $-180°\leq\theta<-90°$ as shown with the dashed line with the direction of the gravity being defined as 0°. Therefore, liquid refrigerant can be prevented from flowing into first inlet header 4*b* in merge portion 15 when two-phase refrigerant flows from second inlet header 4*b* to first heat exchange portion 5*a* during heating.

According to these features, heat transferability of the heat exchange portion can be improved by evenly distributing refrigerant. With improvement in heat transferability, an operation pressure in the refrigeration cycle is lowered on a high-pressure side and increases on a low-pressure side. Therefore, input of the compressor is lowered and performance of the refrigeration cycle can be improved.

By setting the number of flow paths in the outdoor heat exchanger to the sum of the number of flow paths in first heat exchange portion 5*a* and second heat exchange portion 5*b* during heating, a length of each flow path through which refrigerant flows can be shortened. By increasing the number of flow paths and decreasing a length of the flow path during heating, lowering in pressure during evaporation can be lessened.

Second Embodiment

Figure 21:
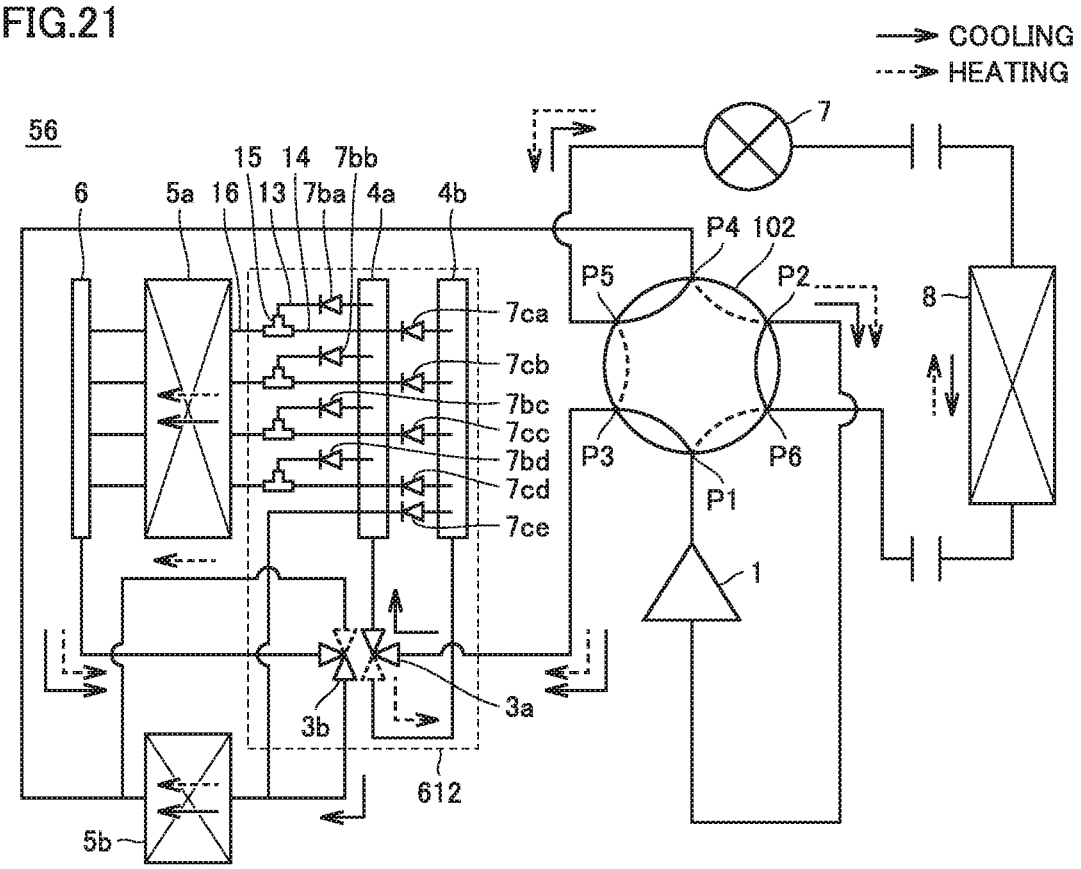
FIG. 21 is a schematic diagram of a construction of a refrigeration cycle apparatus according to a second embodiment.

FIG. 21 is a schematic diagram of a construction of a refrigeration cycle apparatus according to a second embodiment. Referring to FIG. 21, a refrigeration cycle apparatus 56 according to the second embodiment includes compressor 1, six-way valve 102, a flow path switching apparatus 612, expansion valve 7, indoor heat exchanger 8, first heat exchange portion 5*a*, second heat exchange portion 5*b*, and outdoor unit outlet header 6. Flow path switching apparatus 612 includes first flow path switch valve 3*a*, second flow path switch valve 3*b*, first inlet header 4*a*, second inlet header 4*b*, check valves 7*ba* to 7*bd*, and check valves 7*ca* to 7*ce*.

Though refrigeration cycle apparatus 56 according to the second embodiment is basically similar in construction to the first embodiment, it is different in that check valves 7*ba* to 7*bd* and check valves 7*ca* to Ice are provided downstream from first inlet header 4*a* and downstream from second inlet header 4*b*, respectively. Constituent elements identical to those in the first embodiment have the same reference numerals allotted.

Though not shown, a circuit may be formed as flow path switching apparatus 2, by any circuit of flow path switching apparatuses 302 and 402 instead of six-way valve 102. A circuit may be formed as switch portion 3 of flow path switching apparatus 12, by on-off valves 101*e* to 101*g* instead of switch valves 3*a* and 3*b*.

When a circuit in which no check valve is provided downstream from inlet headers 4*a* and 4*b* is configured as in the first embodiment, for example, during cooling, a flow path from first flow path switch valve 3*a* through second inlet header 4*b* to merge portion 15 becomes a stagnation portion where there is no flow. As a result of radiation of heat from gas refrigerant to outside air in the stagnation portion, a liquid refrigerant state is established and refrigerant may stagnate. Stagnation of the liquid refrigerant in the stagnation portion leads to decrease in amount of refrigerant that circulates. Therefore, an amount of refrigerant necessary for exhibiting maximum performance is disadvantageously increased.

In the absence of a check valve, during heating, at least gas refrigerant may flow from merge portion 15 through first inlet header 4*a* into another path. When the gas refrigerant flows in, a degree of dryness of two-phase refrigerant in each path at the time of flow-in is varied from design, and consequently heat transferability is disadvantageously lowered.

In order to avoid such a phenomenon, in the refrigeration cycle apparatus according to the second embodiment, a circuit in which refrigerant is prevented from stagnating and flowing back is formed by providing check valves 7*ba* to 7*bd* and check valves 7*ca* to Ice downstream from first inlet header 4*a* and downstream from second inlet header 4*b*, respectively.

Since cooling and heating operations of the refrigeration cycle apparatus according to the second embodiment are basically similar to those in the first embodiment, they are not mentioned.

Effects of the refrigeration cycle apparatus according to the second embodiment will now be described.

In the second embodiment, by providing check valves 7*ba* to 7*bd* and check valves 7*ca* to Ice downstream from first inlet header 4*a* and second inlet header 4*b*, respectively, refrigerant can be prevented from stagnating on a side of second inlet header 4*b* during cooling. Refrigerant can be prevented from flowing back during heating.

Since backflow of the refrigerant is prevented, an angle of attachment of a gas-side pipe in portion 15 of merge of first inlet header 4*a*, second inlet header 4*b*, and first heat exchange portion 5*a* may be set to $-90° < \theta < 90°$ as shown with the dashed line in FIG. 14 with the direction of the gravity being defined as 0°, and a degree of freedom in arrangement of pipes is enhanced.

By preventing stagnation of refrigerant, an amount of refrigerant necessary for exhibiting maximum performance can be decreased.

Third Embodiment

Figure 22:
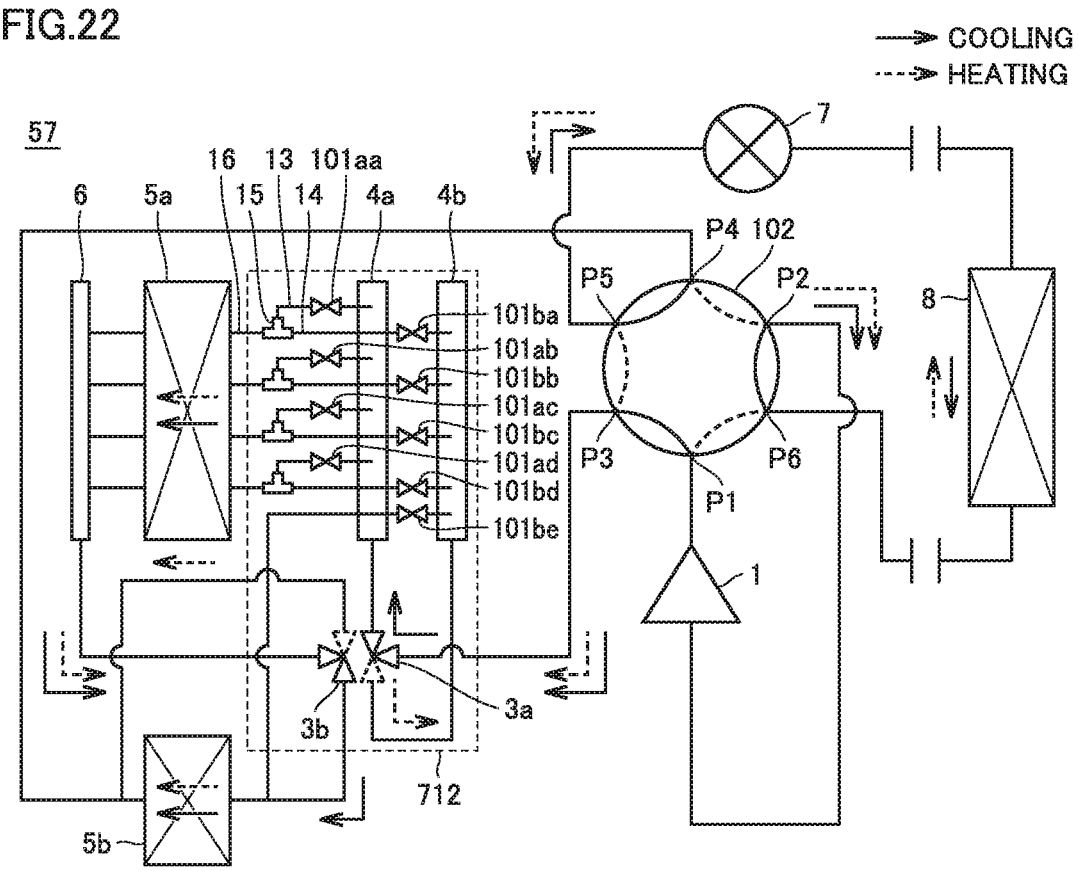
FIG. 22 is a schematic diagram of a construction of a refrigeration cycle apparatus according to a third embodiment.

FIG. 22 is a schematic diagram of a construction of a refrigeration cycle apparatus according to a third embodiment. Referring to FIG. 22, a refrigeration cycle apparatus 57 according to the third embodiment includes compressor 1, six-way valve 102, a flow path switching apparatus 712, expansion valve 7, indoor heat exchanger 8, first heat exchange portion 5*a*, second heat exchange portion 5*b*, and outdoor unit outlet header 6. Flow path switching apparatus 712 includes first flow path switch valve 3*a*, second flow path switch valve 3*b*, first inlet header 4*a*, second inlet header 4*b*, on-off valves 101*aa* to 101*ad*, and on-off valves 101*ba* to 101*be*.

Though refrigeration cycle apparatus 57 according to the third embodiment is basically similar in construction to the first embodiment, it is different in that on-off valves 101*aa* to 101*ad* and on-off valves 101*ba* to 101*be* are provided downstream from first inlet header 4*a* and downstream from second inlet header 4*b*, respectively. Constituent elements identical to those in the first embodiment have the same reference numerals allotted.

Though not shown, a circuit may be formed as flow path switching apparatus 2, by any circuit of flow path switching apparatuses 302 and 402 instead of six-way valve 102, and a circuit may be formed as switch portion 3 of flow path switching apparatus 12, by on-off valves 101*e* to 101*g* instead of switch valves 3*a* and 3*b*.

For example, in the refrigeration cycle apparatus as in the first embodiment, when a frequency of the compressor is lowered due to lowering in high pressure or lowering in capability during heating with a temperature of outdoor air being high, during cooling with a temperature of outdoor air being low, and during low-capacity cooling and heating operations, a necessary compression ratio cannot be ensured. In some cases, a degree of supercooling cannot be ensured at the exit of the condenser due to lowering in high pressure, and two-phase refrigerant may disadvantageously flow into an inlet side of the expansion valve.

When air-conditioning capability at the time of lowering in frequency of the compressor to the lower limit is equal to or higher than aimed capability at the time when a load imposed by air-conditioning is low, turn-on and turn-off of the compressor are disadvantageously frequently repeated.

In order to prevent operations as above, the refrigeration cycle apparatus according to the third embodiment restricts a portion where refrigerant flows into first heat exchange portion 5*a* by closing at least one of on-off valves 101*aa* to 101*ad* and closing on-off valves 101*ba* to 101*be* during a cooling operation with a temperature of outdoor air being low or during a low-capacity cooling operation. Under such control, a circuit which lowers a heat exchanger capacity (an AK value) may be formed. The AK value is calculated by multiplying an overall heat transfer coefficient K in a heat exchanger and a heat transfer area A by each other and it represents heat transfer characteristics of a heat exchanger.

A heat exchanger capacity may be lowered by setting a flow path such that the refrigerant does not go through second heat exchange portion 5*b* by switching second flow path switch valve 3*b* in a direction reverse to normal cooling and heating. Though this method is not particularly described, it is applicable also to the construction in each of the first and second embodiments.

During a heating operation with a temperature of outdoor air being high or during a low-capacity heating operation, a circuit which lowers a heat exchanger capacity (AK value) may be formed by restricting a portion of flow-in of refrigerant into first heat exchange portion 5*a* and second heat exchange portion 5*b* by closing on-off valves 101*aa* to 101*ad* and some (at least one) of on-off valves 101*ba* to 101*be*.

One example of operations of the refrigeration cycle apparatus according to the third embodiment will now be described. Since basic cooling and heating operations are the same as in the first embodiment, they are not mentioned.

During a cooling operation with a temperature of outdoor air being low or during a low-capacity cooling operation, at least one of on-off valves 101*aa* to 101*ad* is closed and on-off valves 101*ba* to 101*be* are closed. Gas refrigerant at a high temperature and a high pressure discharged from compressor 1 flows into first inlet header 4*a* through six-way valve 102 and first flow path switch valve 3*a*, and thereafter flows into first heat exchange portion 5*a* through an open on-off valve of on-off valves 101*aa* to 101*ad* and is condensed therein. Refrigerant condensed in first heat exchange portion 5*a* flows from first heat exchange portion 5*a* through outdoor unit outlet header 6 and second flow path switch valve 3*b* to second heat exchange portion 5*b*, and is further condensed therein. Thereafter, refrigerant flows from second heat exchange portion 5*b* through six-way valve 102 and expansion valve 7 to indoor heat exchanger 8 and evaporates therein, and returns to compressor 1 through six-way valve 102 (see a solid arrow in FIG. 22).

A heat exchanger capacity may be varied by changing a flow path by using second flow path switch valve 3*b* so as not to go through second heat exchange portion 5*b*.

During a heating operation with a temperature of outdoor air being high or during a low-capacity heating operation, on-off valves 101*aa* to 101*ad* and some (at least one) of on-off valves 101*ba* to 101*be* are closed. Gas refrigerant at a high temperature and a high pressure flows from compressor 1 through six-way valve 102 into indoor heat exchanger 8 and is condensed therein. Refrigerant condensed in indoor heat exchanger 8 flows through expansion valve 7, six-way valve 102, and first flow path switch valve 3*a* into second inlet header 4*b*. Thereafter, refrigerant flows from second inlet header 4*b* through an open on-off valve among on-off valves 101*ba* to 101*be* into first heat exchange portion 5*a* or second heat exchange portion 5*b* and evaporates therein. Refrigerant which flows into first heat exchange portion 5*a* flows through outdoor unit outlet header 6 and second flow path switch valve 3*b*, merges with refrigerant which has passed through second heat exchange portion 5*b* on the exit side of second heat exchange portion 5*b*, and thereafter returns to compressor 1 through six-way valve 102 (see a dashed arrow in FIG. 22).

Effects of the refrigeration cycle apparatus according to the third embodiment will now be described. The refrigeration cycle apparatus in the third embodiment can vary a capacity of a heat exchanger by opening and closing an on-off valve and switching a flow path switch valve during heating with a temperature of outdoor air being high, during cooling with a temperature of outdoor air being low, or during low-capacity cooling and heating operations.

In the third embodiment, a compression ratio and a degree of supercooling can be ensured by lowering a heat exchange capacity (AK value) and increasing a condensation pressure by closing at least one of on-off valves 101*aa* to 101*ad* and closing on-off valves 101*ba* to 101*be* during a cooling operation with a temperature of outdoor air being low or during a low-capacity cooling operation.

A compression ratio and a degree of supercooling can be ensured by lowering a heat exchange capacity (AK value) and increasing a condensation pressure by closing on-off valves 101*aa* to 101*ad* and closing at least one of on-off valves 101*ba* to 101*be* during a heating operation with a temperature of outdoor air being high or during a low-capacity heating operation.

Frequent repetition of turn-on and turn-off of the compressor can be prevented by closing at least one of on-off valves 101*aa* to 101*ad* and closing on-off valves 101*ba* to 101*be* during a cooling operation with a temperature of outdoor air being low or during a low-capacity cooling operation.

Frequent repetition of turn-on and turn-off of the compressor can be prevented by closing on-off valves 101*aa* to 101*ad* and closing at least one of on-off valves 101*ba* to 101*be* during a heating operation with a temperature of outdoor air being high or during a low-capacity heating operation.

By thus allowing operations to continue even during heating with a temperature of outdoor air being high, during cooling with a temperature of outdoor air being low, or during low-capacity cooling and heating operations, a range in which the refrigeration cycle apparatus operates can be broader than in a conventional example.

Fourth Embodiment

Figure 23:
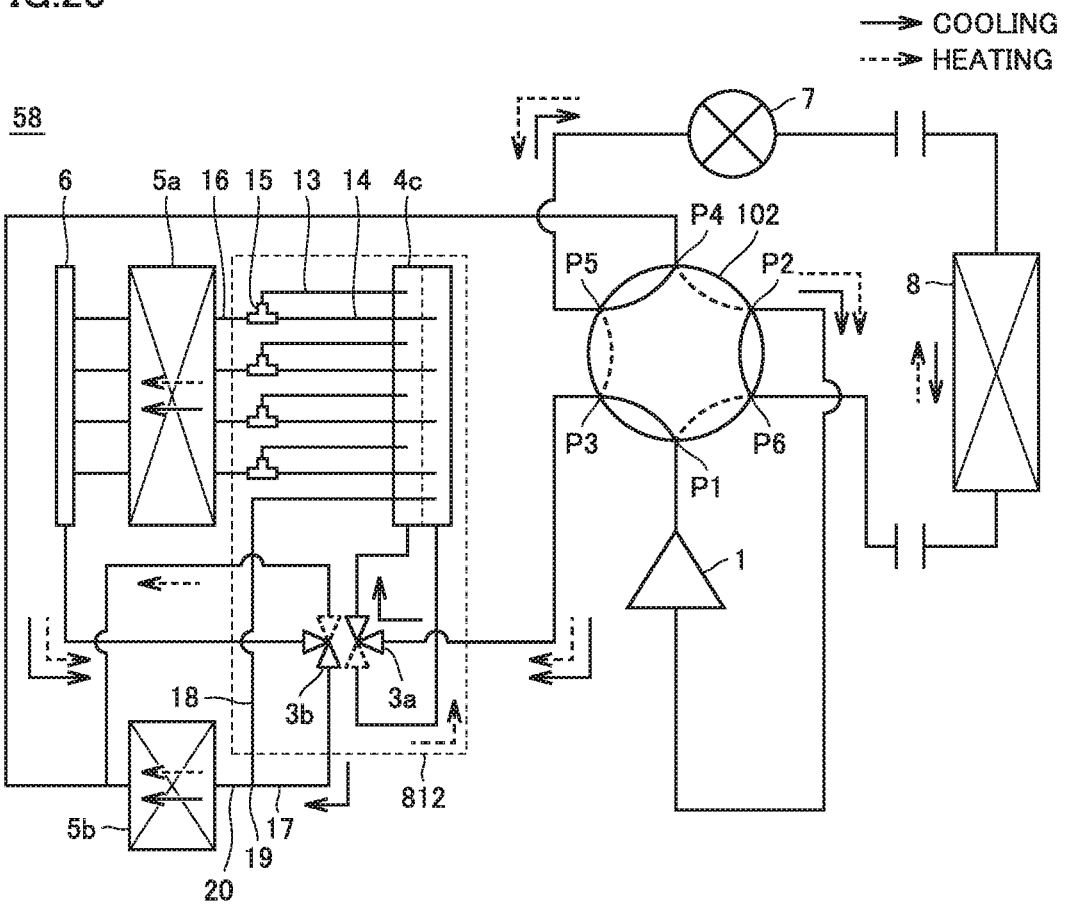
FIG. 23 is a schematic diagram of a construction of a refrigeration cycle apparatus according to a fourth embodiment.

FIG. 23 is a schematic diagram of a construction of a refrigeration cycle apparatus according to a fourth embodiment. Referring to FIG. 23, a refrigeration cycle apparatus 58 according to the fourth embodiment includes compressor 1, six-way valve 102, a flow path switching apparatus 812, expansion valve 7, indoor heat exchanger 8, first heat exchange portion 5*a*, second heat exchange portion 5*b*, and outdoor unit outlet header 6. Flow path switching apparatus 812 includes first flow path switch valve 3*a*, second flow path switch valve 3*b*, and a third inlet header 4*c*.

Though refrigeration cycle apparatus 58 according to the fourth embodiment is basically similar in construction to the first embodiment, it is different in that integrated third inlet header 4*c* of which inner volume is divided into two sections is provided instead of first inlet header 4*a* and second inlet header 4*b*. Constituent elements identical to those in the first embodiment have the same reference numerals allotted.

Figure 24:
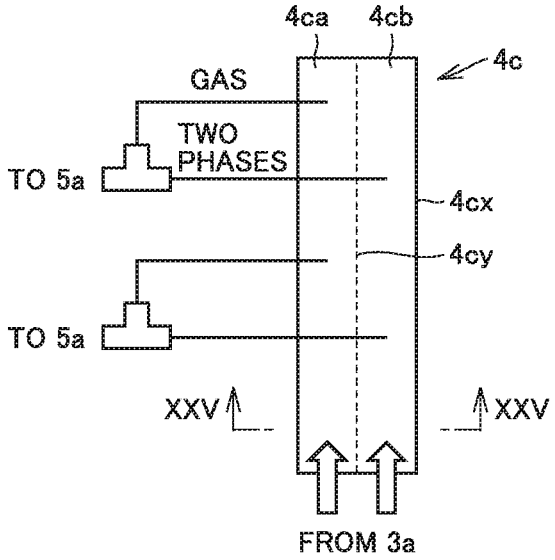
FIG. 24 is a schematic diagram of a third inlet header 4*c* of the refrigeration cycle apparatus according to the fourth embodiment.
Figure 25:
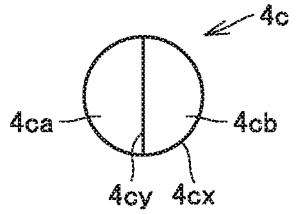
FIG. 25 is a diagram showing a cross-section along the line XXV-XXV in FIG. 24.

FIG. 24 is a schematic diagram of third inlet header 4*c* of the refrigeration cycle apparatus according to the fourth embodiment. FIG. 25 is a diagram showing a cross-section along the line XXV-XXV in FIG. 24. Referring to FIGS. 24 and 25, third inlet header 4*c* includes a cylindrical header casing 4*cx* and a partition plate 4*cy* provided in casing 4*cx*. Partition plate 4*cy* divides third inlet header 4*c* into a region 4*ca* and a region 4*cb*. Region 4*ca* is a region where gas refrigerant flows during a cooling operation and corresponds to inlet header 4*a*. Region 4*cb* is a region where two-phase refrigerant flows during a heating operation and corresponds to inlet header 4*b*. Region 4*ca* and region 4*cb* are separated by partition plate 4*cy* such that refrigerant does not leak therebetween.

Though header casing 4*cx* is cylindrical in FIG. 25, it may be in a shape of a parallelepiped with a rectangular cross-section. Though an inlet of inlet header 4*c* into which refrigerant flows from first flow path switch valve 3*a* is provided in a lower portion of the header, the inlet may be provided at any position in a side surface or in an upper portion.

Partition plate 4*cy* is preferably provided such that gas-side region 4*ca* occupies 50% or more of a volume of header casing 4*cx*. This is because pressure loss is desirably suppressed in gas-side region 4*ca* at the time of distribution and a diameter of a pipe is desirably made smaller in two-phase-side region 4*cb* so as not to be affected by the gravity or inertial force at the time of distribution.

For similar reasons, a flow path is preferably configured such that relation of $D5>D6$ and $L5<L6$ is satisfied where D5 and L5 represent a diameter and a length of pipe 13 from gas-side region 4*ca* of third inlet header 4*c* to merge portion 15, respectively, and D6 and L6 represent a diameter and a length of pipe 14 from two-phase-side region 4*cb* of third inlet header 4*c* to merge portion 15, respectively. A flow path is preferably configured such that relation of D8>D9 and L8<L9 is satisfied where D8 and L8 represent a diameter and a length of pipe 17 from second flow path switch valve 3*b* to merge portion 19, respectively and D9 and L9 represent a diameter and a length of pipe 18 from two-phase-side region 4*cb* of third inlet header 4*c* to merge portion 19, respectively.

Similarly to the shape shown in FIGS. 13 and 14, a gas-side pipe is preferably attached in portion 15 or 19 of merge of third inlet header 4*c* with first heat exchange portion 5*a* or second heat exchange portion 5*b* in FIG. 23 such that an angle of attachment thereof is set to $90° < \theta \leq 180°$ or $-180° \leq \theta < -90°$ with the direction of the gravity being defined as 0°.

Since the refrigeration cycle apparatus according to the fourth embodiment is basically similar in operation examples to the first embodiment, they are not mentioned.

Effects of the refrigeration cycle apparatus according to the fourth embodiment will now be described. By providing integrated third inlet header 4*c* instead of first inlet header 4*a* and second inlet header 4*b*, the refrigeration cycle apparatus according to the fourth embodiment can further be smaller in number of components while it is similar in effects to the first embodiment. An attachment operation can be simplified by reducing the number of components. Cost can be reduced by reducing the number of components and simplifying the attachment operation.

Pressure loss at the time of condensation can be lowered by setting a volume on the gas side of third inlet header 4*c* to ≥50% (because pressure loss is lessened by ensuring a flow path on the gas-side). By lessening pressure loss at the time of condensation, increase in pressure on a high-pressure side of the compressor can be lessened. By suppressing increase in pressure on the high-pressure side of the compressor, a temperature at the exit of the compressor can be lowered. In addition, by suppressing increase in pressure on the high-pressure side of the compressor, input at the compressor can be lowered.

Fifth Embodiment

Figure 26:
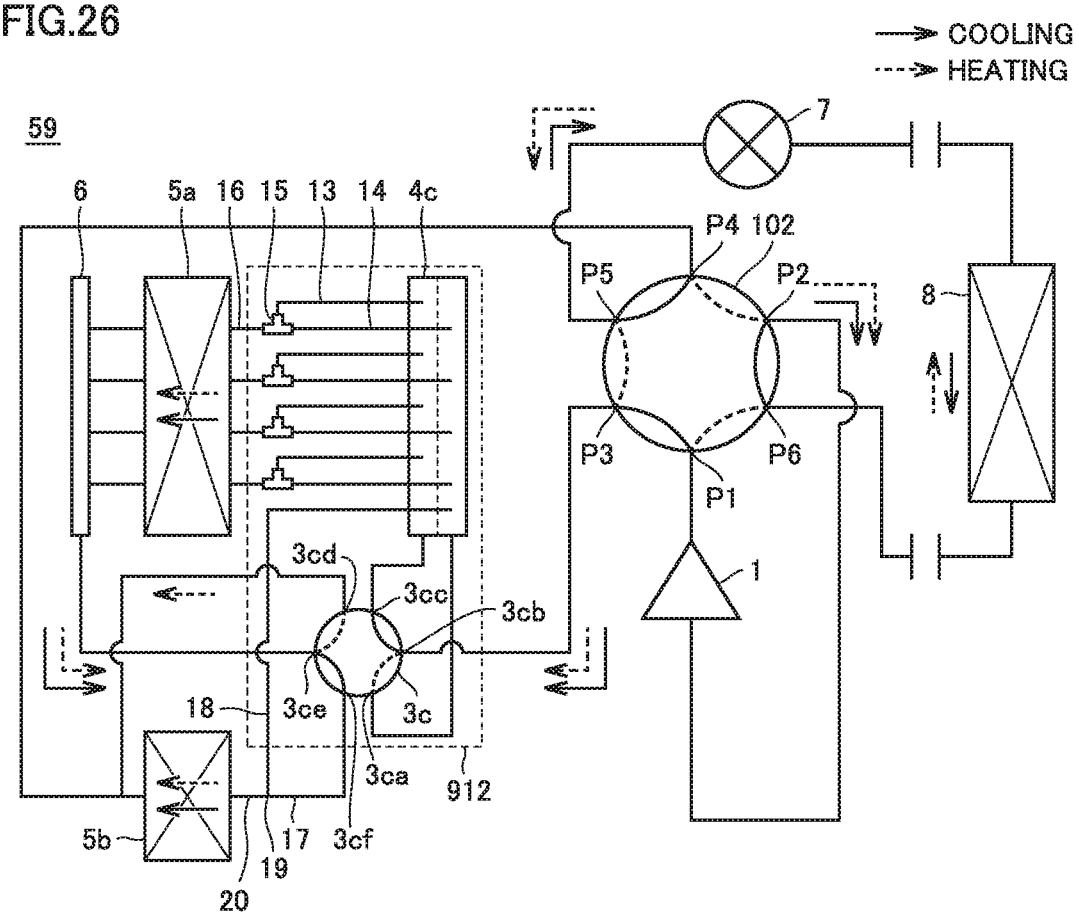
FIG. 26 is a schematic diagram of a construction of a refrigeration cycle apparatus according to a fifth embodiment.

FIG. 26 is a schematic diagram of a construction of a refrigeration cycle apparatus according to a fifth embodiment. Referring to FIG. 26, a refrigeration cycle apparatus 59 according to the fifth embodiment includes compressor 1, six-way valve 102, a flow path switching apparatus 912, expansion valve 7, indoor heat exchanger 8, first heat exchange portion 5*a*, second heat exchange portion 5*b*, and outdoor unit outlet header 6. Flow path switching apparatus 912 includes a third flow path switch valve 3*c* and third inlet header 4*c*.

Though refrigeration cycle apparatus 59 according to the fifth embodiment is basically similar in construction to the fourth embodiment, it is different in that integrated third flow path switch valve 3*c* is provided instead of first flow path switch valve 3*a* and second flow path switch valve 3*b*. Constituent elements identical to those in the first embodiment have the same reference numerals allotted.

Figure 27:
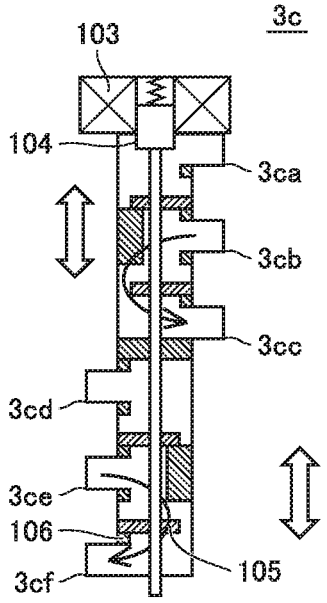
FIG. 27 is a diagram showing a state during cooling of a third flow path switch valve 3*c* of the refrigeration cycle apparatus according to the fifth embodiment.
Figure 28:
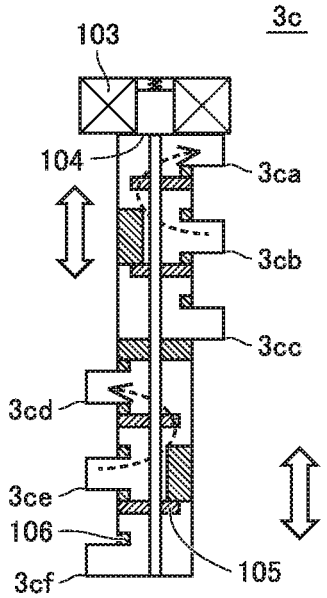
FIG. 28 is a diagram showing a state during heating of third flow path switch valve 3*c* of the refrigeration cycle apparatus according to the fifth embodiment.

FIG. 27 is a diagram showing a state during cooling of third flow path switch valve 3*c* in the refrigeration cycle apparatus according to the fifth embodiment. FIG. 28 is a diagram showing a state during heating of third flow path switch valve 3*c* in the refrigeration cycle apparatus according to the fifth embodiment.

Referring to FIGS. 27 and 28, third flow path switch valve 3*c* includes ports 3*ca* to 3*cf* through which refrigerant flows in and out, a plurality of valve discs 105, a plunger (a moving core) 104 which drives the plurality of valve discs 105 upward and downward with a single shaft, a coil 103 which drives plunger 104, and a valve seat 106. Third flow path switch valve 3*c* functions to switch a flow path by controlling valve discs 105 with coil 103 during cooling and heating operations. During cooling, as shown in FIG. 27, no power is fed to coil 103. Plunger 104 moves downward by a spring so that a flow path through which refrigerant flows is formed as shown with a solid arrow. During heating, as shown in FIG. 28, power is fed to coil 103. Plunger 104 is attracted and moved upward so that a flow path through which refrigerant flows is formed as shown with a dashed arrow.

In FIG. 26, a flow path is preferably formed such that relation of D5>D6 and L5<L6 is satisfied where D5 and L5 represent a diameter and a length of pipe 13 from the gas side of third inlet header 4*c* to merge portion 15, respectively, and D6 and L6 represent a diameter and a length of pipe 14 from the two-phase side of third inlet header 4*c* to merge portion 15, respectively. A flow path is preferably formed such that relation of D7>D8 and L7<L8 is satisfied where D7 and L7 represent a diameter and a length of pipe 17 from third flow path switch valve 3*c* to merge portion 19, respectively and D8 and L8 represent a diameter and a length of pipe 18 from the two-phase side of third inlet header 4*c* to merge portion 19, respectively.

Operation examples of the refrigeration cycle apparatus according to the fifth embodiment will now be described. Since basic cooling and heating operations are the same as in the fourth embodiment, they are not mentioned.

During cooling, third flow path switch valve 3*c* is in a state shown in FIG. 27. Refrigerant which flows in from six-way valve 102 (port P3) into port 3*cb* flows out of port 3*cc* toward third inlet header 4*c*. Since a flow path is closed by valve disc 105 and valve seat 106, no refrigerant flows through port 3*ca*.

Refrigerant which flows from outdoor unit outlet header 6 into port 3*ce* flows out of port 3*cf* toward second heat exchange portion 5*b*. Since a flow path is closed by valve disc 105 and valve seat 106, no refrigerant flows through port 3*cd*.

During heating, third flow path switch valve 3*c* is in a state shown in FIG. 28. Refrigerant which flows from six-way valve 102 (port P3) into port 3*cb* flows out of port 3*ca* toward third inlet header 4*c*. Since a flow path is closed by valve disc 105 and valve seat 106, no refrigerant flows through port 3*cc*.

Refrigerant which flows from outdoor unit outlet header 6 into port 3*ce* flows out of port 3*cd* toward a flow path on the exit side of second heat exchange portion 5*b*, and merges with refrigerant which has passed through second heat exchange portion 5*b*. Since a flow path is closed by valve disc 105 and valve seat 106, no refrigerant flows through port 3*cf*.

Effects of the refrigeration cycle apparatus according to the fifth embodiment will now be described. By providing integrated third flow path switch valve 3*c* instead of first flow path switch valve 3*a* and second flow path switch valve 3*b*, the refrigeration cycle apparatus according to the fifth embodiment can further be smaller in number of components while it is similar in effects to the fourth embodiment.

Since a plurality of valve discs are moved in third flow path switch valve 3*c* with a single shaft, a plunger (a drive portion) and a coil can be implemented by a single feature. Therefore, the construction can be low in cost.

Third flow path switch valve 3*c* can simultaneously control a plurality of flow paths by controlling a single-shaft valve disc, and it is excellent in operability.

Sixth Embodiment

Figure 29:
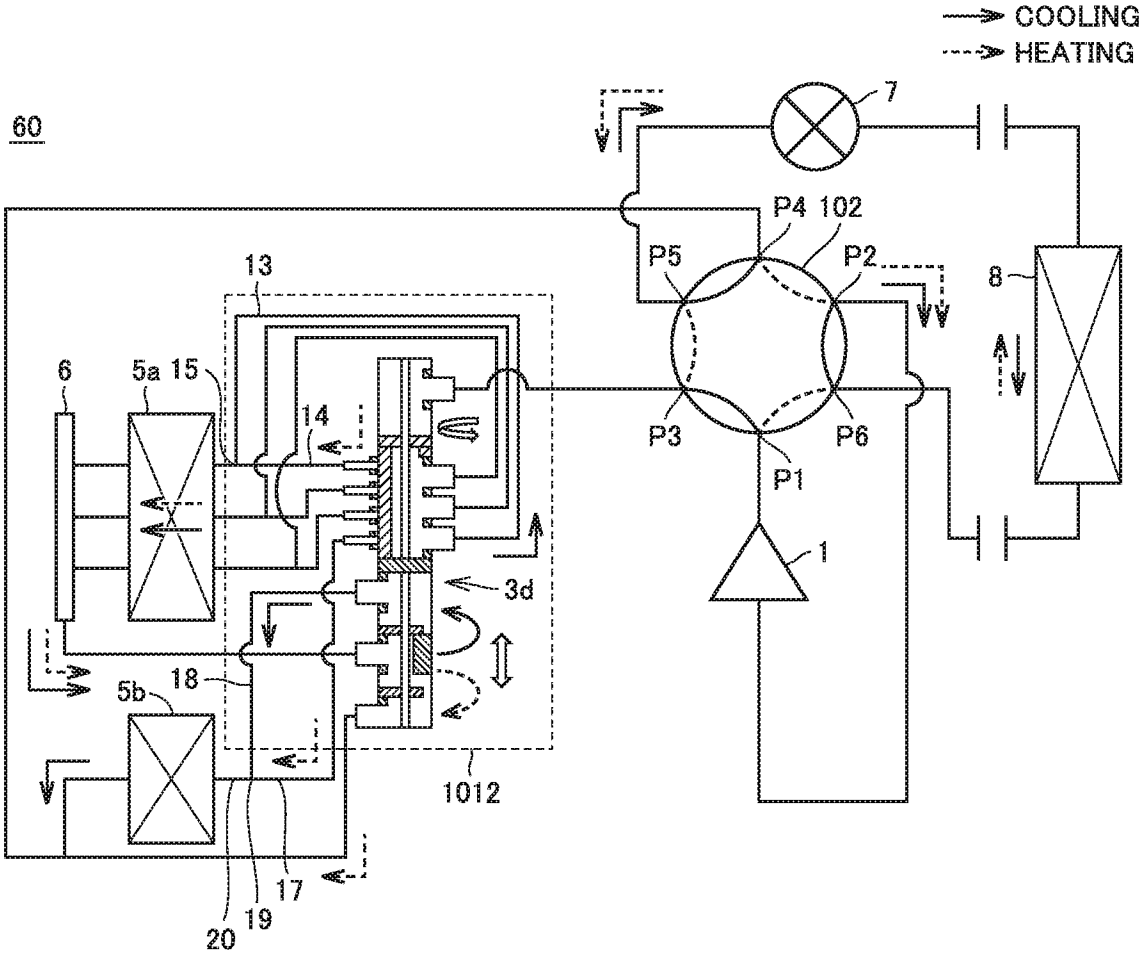
FIG. 29 is a schematic diagram of a construction of a refrigeration cycle apparatus according to a sixth embodiment.

FIG. 29 is a schematic diagram of a construction of a refrigeration cycle apparatus according to a sixth embodiment. Referring to FIG. 29, a refrigeration cycle apparatus 60 according to the sixth embodiment includes compressor 1, six-way valve 102, flow path switching apparatus 1012, first heat exchange portion 5*a*, second heat exchange portion 5*b*, outdoor unit outlet header 6, expansion valve 7, and indoor heat exchanger 8. Flow path switching apparatus 1012 includes a fourth flow path switch valve 3*d*.

Though refrigeration cycle apparatus 60 according to the sixth embodiment is basically the same in construction as the first embodiment, it is different in that integrated fourth flow path switch valve 3*d* is provided instead of first flow path switch valve 3*a*, second flow path switch valve 3*b*, first inlet header 4*a*, and second inlet header 4*b*. Constituent elements identical to those in the first embodiment have the same reference numerals allotted.

Figure 30:
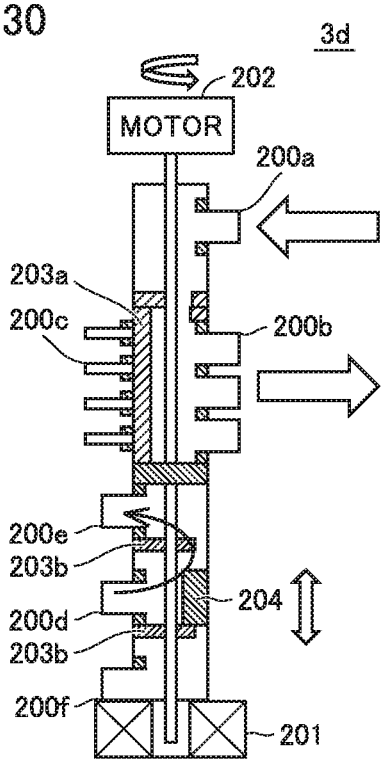
FIG. 30 is a diagram showing a state during cooling of a fourth flow path switch valve 3*d* of the refrigeration cycle apparatus according to the sixth embodiment.
Figure 31:
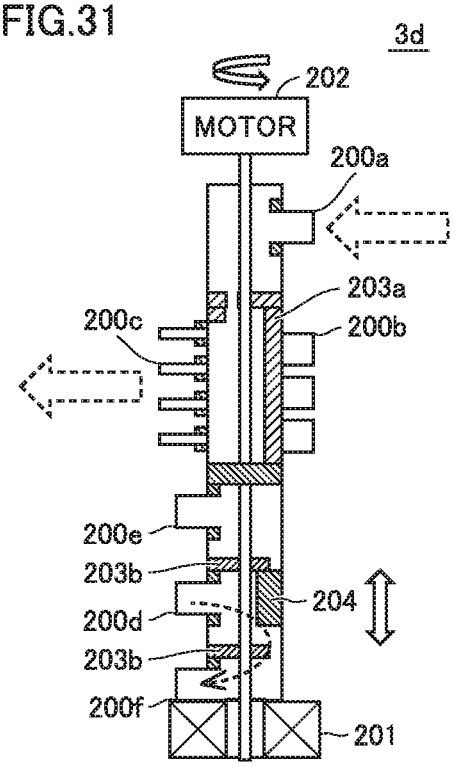
FIG. 31 is a diagram showing a state during heating of fourth flow path switch valve 3*d* of the refrigeration cycle apparatus according to the sixth embodiment.

FIG. 30 is a diagram showing a state during cooling of fourth flow path switch valve 3*d* in the refrigeration cycle apparatus according to the sixth embodiment. FIG. 31 is a diagram showing a state during heating of fourth flow path switch valve 3*d* in the refrigeration cycle apparatus according to the sixth embodiment.

Referring to FIGS. 30 and 31, fourth flow path switch valve 3*d* includes ports 200*a* to 200*f* through which a heat exchange medium which flows in a refrigeration cycle flows in or out, a valve disc 203*a* which is a single-shaft valve disc and in which a valve circumferentially rotates, a motor 202 which rotates valve disc 203*a*, a valve disc 203*b* which is driven upward and downward, a coil 201 which drives valve disc 203*b* upward and downward, and a valve seat 204.

Similarly to the shape shown in FIGS. 13 and 14, a gas-side pipe is preferably attached in portion 15 or 19 of merge of fourth flow path switch valve 3*d* with first heat exchange portion 5*a* or second heat exchange portion 5*b* in FIG. 30 such that an angle of attachment thereof is set to $90° < \theta \leq 180°$ or $-180° \leq \theta < -90°$ as shown with a dashed line with the direction of gravity being defined as 0°.

In portion 15 of merge of a port 200*b* (on a gas side) of fourth flow path switch valve 3*d* and a port 200*c* (a two-phase side) of fourth flow path switch valve 3*d*, a flow path is preferably formed such that relation of $D9 > D10$ and $L9 < L10$ is satisfied where D9 and L9 represent a diameter and a length of pipe 13 from port 200*b* (on the gas side) of fourth flow path switch valve 3*d* to merge portion 15, respectively and D10 and L10 represent a diameter and a length of pipe 14 from port 200*c* (on the two-phase side) of fourth flow path switch valve 3*d* to merge portion 15, respectively. Similarly, in portion 19 of merge of first heat exchange portion 5*a* and second heat exchange portion 5*b*, a flow path is preferably formed such that relation of $D1 > D12$ and $L11 < L12$ is satisfied where D11 and L11 represent a diameter and a length of a pipe from fourth flow path switch valve 3*d* (port 200*e*) to merge portion 19, respectively and D12 and L12 represent a diameter and a length of a pipe from a liquid side (port 200*c*) of fourth flow path switch valve 3*d* to merge portion 19, respectively.

Operation examples of the refrigeration cycle apparatus according to the sixth embodiment will now be described. Since basic cooling and heating operations are the same as in the fourth embodiment, they are not mentioned.

During cooling, fourth flow path switch valve 3*d* is in a state shown in FIG. 30. Refrigerant which flows from six-way valve 102 (port P3) into port 200*a* flows out of port 200*b* toward first heat exchange portion 5*a*. Since a flow path is closed by valve disc 203*a*, no refrigerant flows through port 200*c*.

Refrigerant which flows from outdoor unit outlet header 6 into port 200*d* flows out of port 200*e* toward second heat exchange portion 5*b*. Since a flow path is closed by valve disc 203*b* and valve seat 204, no refrigerant flows through port 200*f*.

During heating, fourth flow path switch valve 3*d* is in a state shown in FIG. 31. Refrigerant which flows from six-way valve 102 (port P3) into port 200*a* flows out of port 200*c* and flows in parallel to first heat exchange portion 5*a* and second heat exchange portion 5*b*. Since a flow path is closed by valve disc 203*a*, no refrigerant flows to port 200*b*.

Refrigerant which flows from outdoor unit outlet header 6 into port 200*d* flows out of port 200*f* into a flow path on the exit side of second heat exchange portion 5*b* and merges with refrigerant which has passed through second heat exchange portion 5*b*. Since a flow path is closed by valve disc 203*b* and valve seat 204, no refrigerant flows through port 200*e*.

Effects of the refrigeration cycle apparatus according to the sixth embodiment will now be described. By providing integrated fourth flow path switch valve 3*d* instead of first flow path switch valve 3*a*, second flow path switch valve 3*b*, first inlet header 4*a*, and second inlet header 4*b*, the refrigeration cycle apparatus according to the sixth embodiment can be smaller in number of components while it is similar in effects to the first embodiment.

Seventh Embodiment

In the sixth embodiment, integrated fourth flow path switch valve 3*d* is provided and one component serves as inlet headers 4*a* and 4*b* and switch valves 3*a* and 3*b*. A high- and low-pressure heat exchanger, a receiver, and a gas-liquid separator may be used as being combined with the features in the sixth embodiment.

Figure 32:
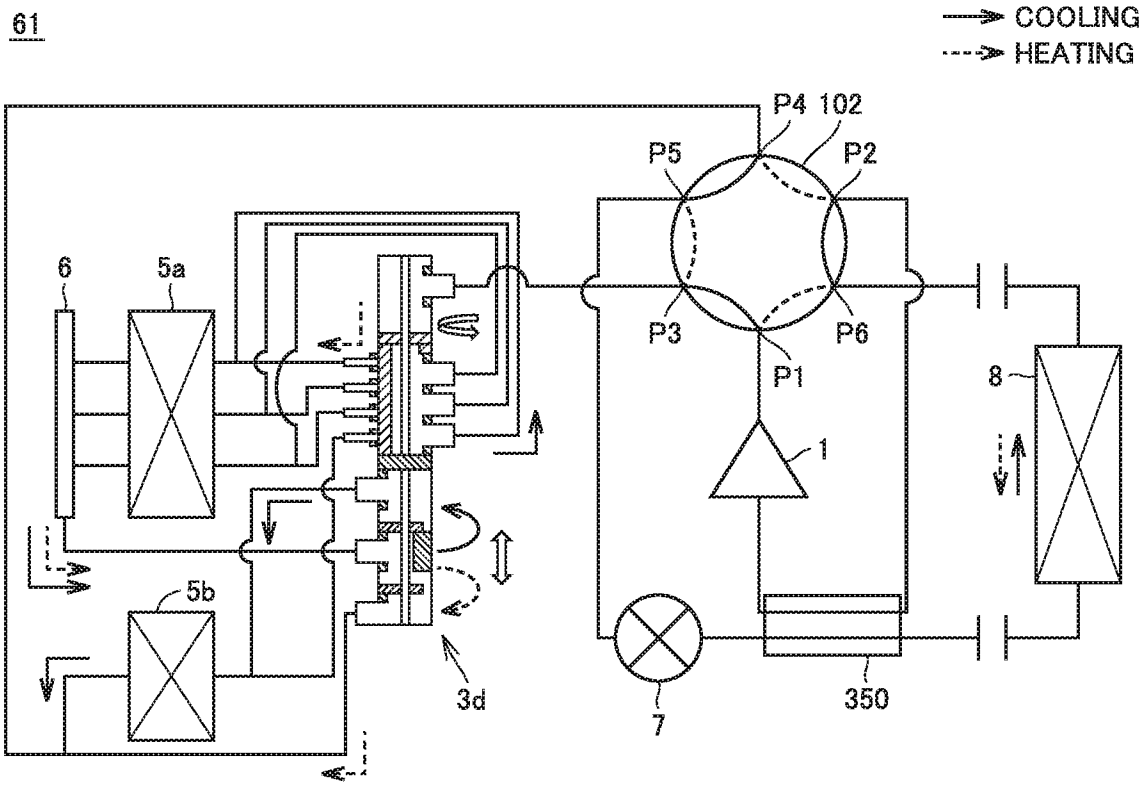
FIG. 32 is a diagram showing a first construction example of a refrigeration cycle apparatus according to a seventh embodiment.
Figure 33:
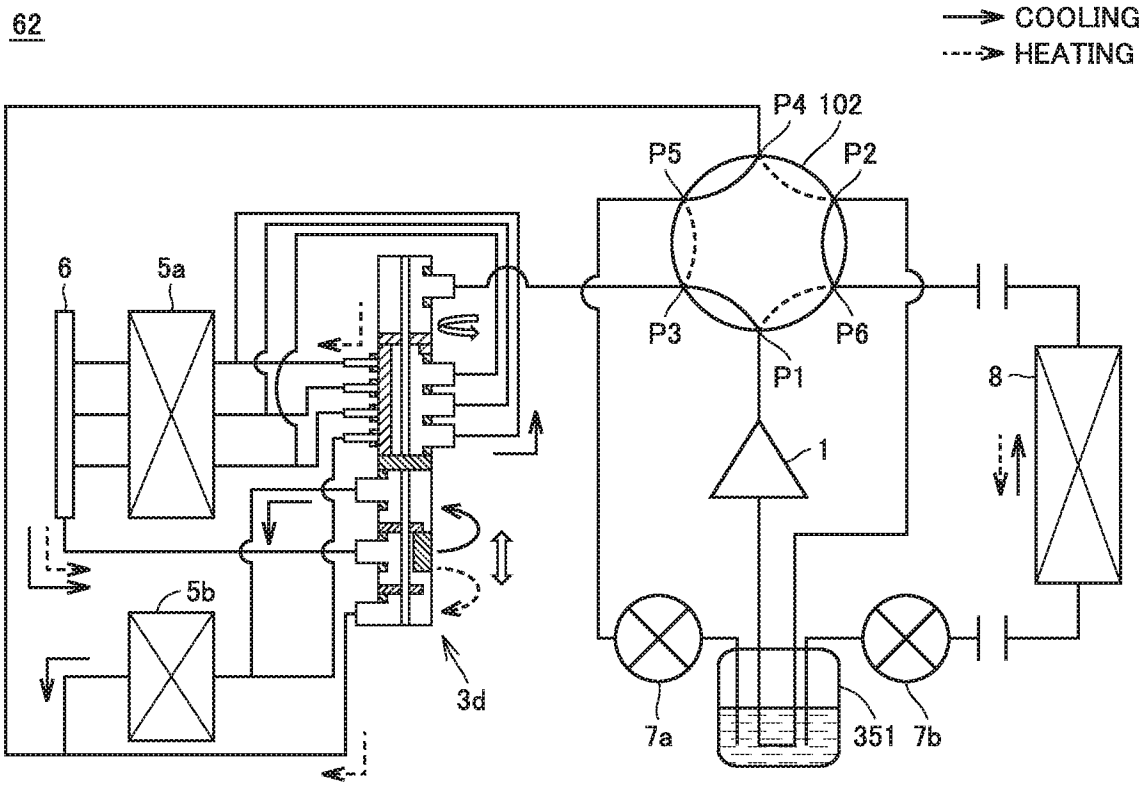
FIG. 33 is a diagram showing a second construction example of a refrigeration cycle apparatus according to the seventh embodiment.
Figure 34:
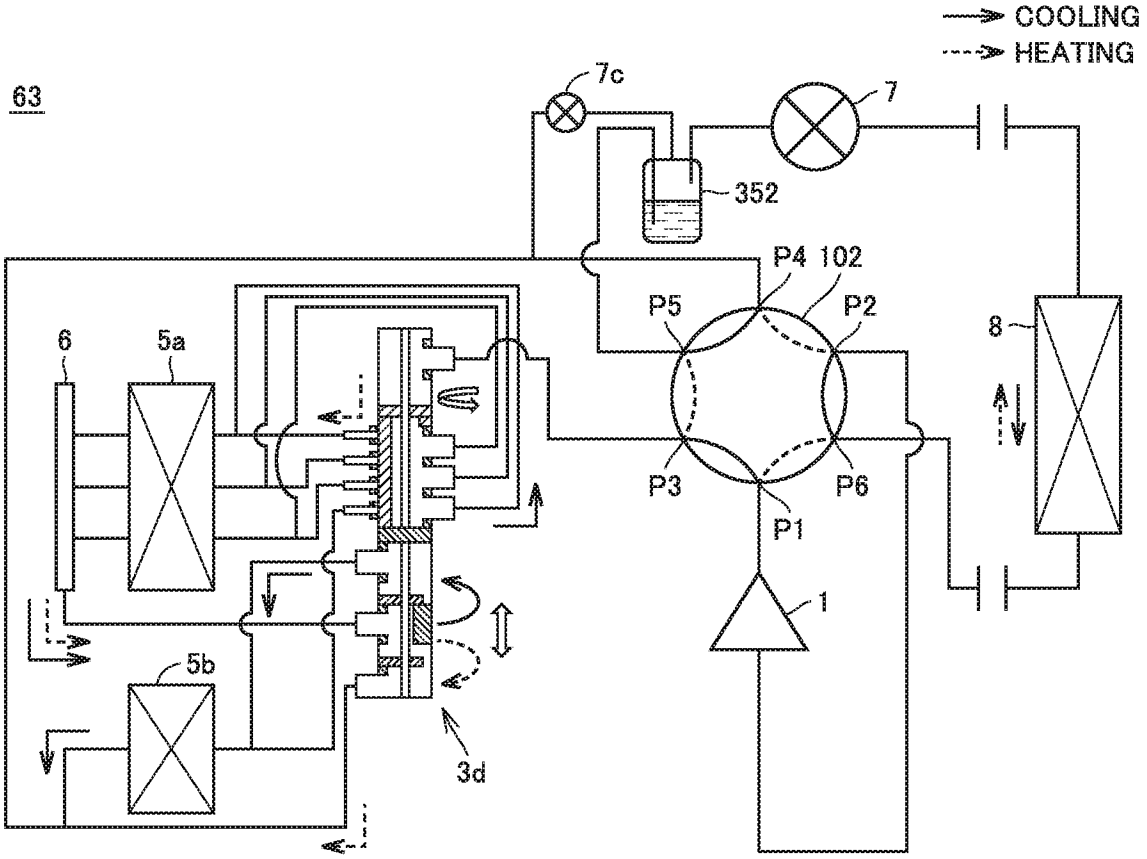
FIG. 34 is a diagram showing a third construction example of a refrigeration cycle apparatus according to the seventh embodiment.

FIG. 32 is a diagram showing a first construction example of a refrigeration cycle apparatus according to a seventh embodiment. FIG. 33 is a diagram showing a second construction example of a refrigeration cycle apparatus according to the seventh embodiment. FIG. 34 is a diagram showing a third construction example of a refrigeration cycle apparatus according to the seventh embodiment.

The construction examples in FIGS. 32 to 34 are identical in that the refrigeration cycle apparatus includes compressor 1, six-way valve 102, fourth flow path switch valve 3*d*, first heat exchange portion 5*a*, second heat exchange portion 5*b*, outdoor unit outlet header 6, expansion valve 7, and indoor heat exchanger 8.

In addition to these features, a feature below is added such that refrigerant is in a supercooled state or a saturated liquid state in a flow path from a side downstream from indoor heat exchanger 8 to expansion valve 7 or 7*b* or 7*c* during a heating operation.

A refrigeration cycle apparatus 61 shown in FIG. 32 is different from the refrigeration cycle apparatus in the sixth embodiment in further including a high- and low-pressure heat exchanger 350. High- and low-pressure heat exchanger 350 is configured to exchange heat between refrigerant which flows from indoor heat exchanger 8 toward expansion valve 7 during heating and refrigerant which flows through a pipe on an inlet side of compressor 1.

A refrigeration cycle apparatus 62 shown in FIG. 33 is different from the refrigeration cycle apparatus in the sixth embodiment in further including a receiver 351 and including an expansion valve 7*a* and an expansion valve 7*b* instead of expansion valve 7. Receiver 351 is configured to exchange heat between liquid refrigerant stored between expansion valve 7*b* on a high-pressure side and expansion valve 7*a* on a low-pressure side during heating and refrigerant which flows through a pipe on the inlet side of compressor 1.

A refrigeration cycle apparatus 63 shown in FIG. 34 is different from the refrigeration cycle apparatus in the sixth embodiment in further including a gas-liquid separator 352 and a gas escape expansion valve 7*c*.

According to the constructions shown in FIGS. 32 to 34, refrigerant can be set to a supercooled state or a saturated liquid state in a flow path from the side downstream from indoor heat exchanger 8 to expansion valve 7 or 7*b* or 7*c* during the heating operation.

In an attempt to obtain a similar effect on an indoor side, each element may be provided to achieve the supercooled state or the saturated liquid state downstream from expansion valve 7 during the cooling operation. Though illustration is not provided for the sake of brevity, first heat exchange portion 5*a*, second heat exchange portion 5*b*, and indoor heat exchanger 8 may be replaced with a first indoor unit heat exchange portion, a second indoor unit heat exchange portion, and an outdoor heat exchanger, respectively, and a flow of refrigerant may be reversed between cooling and heating.

Operation examples of the refrigeration cycle apparatus according to the seventh embodiment will now be described. Since basic cooling and heating operations are the same as in the sixth embodiment, they are not mentioned.

In refrigeration cycle apparatus 61 shown in FIG. 32, during heating, refrigerant condensed in indoor heat exchanger 8 exchanges heat in high- and low-pressure heat exchanger 350 with refrigerant at a low pressure and a low temperature which flows from port P2 of six-way valve 102 toward compressor 1. After a degree of supercooling is increased, refrigerant flows into expansion valve 7.

In refrigeration cycle apparatus 61 shown in FIG. 32, during cooling, refrigerant at a low temperature and a low pressure after it flows out of expansion valve 7 is small in temperature difference from refrigerant at a low pressure and a low temperature which flows from port P2 of six-way valve 102 toward compressor 1. Therefore, refrigerant does not exchange heat in high- and low-pressure heat exchanger 350 but flows into indoor heat exchanger 8.

In refrigeration cycle apparatus 62 shown in FIG. 33, during heating, refrigerant condensed in indoor heat exchanger 8 expands in expansion valve 7*b* on the high-pressure side, and thereafter it is subjected to gas-liquid separation in receiver 351. Refrigerant exchanges heat in receiver 351 with refrigerant at a low pressure and a low temperature which flows from port P2 of six-way valve 102 toward compressor 1, and at least saturated liquid flows into expansion valve 7*a* on the low-pressure side.

In refrigeration cycle apparatus 62 shown in FIG. 33, during cooling, refrigerant which flows out of expansion valve 7*a* is subjected to gas-liquid separation in receiver 351, exchanges heat with refrigerant at a low pressure and a low temperature which flows from port P2 of six-way valve 102 toward compressor 1, and at least saturated liquid flows into expansion valve 7*b* on the high-pressure side.

In refrigeration cycle apparatus 63 shown in FIG. 34, during heating, refrigerant condensed in indoor heat exchanger 8 is expanded in expansion valve 7 and thereafter it is subjected to gas-liquid separation in gas-liquid separator 352. Saturated liquid flows into port P5 of six-way valve 102. Gas refrigerant separated in gas-liquid separator 352 flows through expansion valve 7*c*, merges with refrigerant that evaporated, and flows into port P4 of six-way valve 102.

In refrigeration cycle apparatus 63 shown in FIG. 34, during cooling, gas-liquid separator 352 is filled with condensed liquid refrigerant, and saturated liquid or supercooled liquid flows into expansion valve 7.

Effects of the refrigeration cycle apparatus according to the seventh embodiment will now be described.

Refrigeration cycle apparatus 61 shown in FIG. 32 includes high- and low-pressure heat exchanger 350 and expansion valve 7, and can achieve a higher degree of supercooling on the high-pressure side of expansion valve 7 by exchanging heat between high-pressure liquid refrigerant and low-pressure gas refrigerant in a supercooled region on the exit side of the condenser at the time of condensation. As a high degree of supercooling is obtained on the high-pressure side of expansion valve 7, a degree of dryness on the inlet side of the evaporator which is a low-pressure portion can be lowered. Since a phase of refrigerant is closer toward a single phase of liquid from two phases owing to lowering in degree of dryness on the inlet side of the evaporator, refrigerant at port 200*c* (a side of flow-in of two-phase refrigerant in inlet header 4*b* in the first embodiment and inlet header 4*c* in the third embodiment) can more evenly be distributed.

Refrigeration cycle apparatus 62 shown in FIG. 33 includes receiver 351 and divided high- and low-pressure side expansion valves 7*a* and 7*b* so that a degree of dryness on the evaporator inlet side of receiver 351 which is a low-pressure portion can be lowered as a result of flow-in of saturated liquid separated into two phases in receiver 351 representing an intermediate pressure region into the low-pressure-side expansion valve. Since a high degree of supercooling is obtained on the high-pressure side, a degree of dryness on the evaporator inlet side which is the low pressure portion can be lowered. Since refrigerant is closer toward a single phase of liquid from two phases owing to lowering in degree of dryness on the evaporator inlet side, refrigerant at port 200*c* (a side of flow-in of two-phase refrigerant of inlet header 4*b* in the first embodiment and inlet header 4*c* in the third embodiment) can more evenly be distributed.

Refrigeration cycle apparatus 63 shown in FIG. 34 includes gas-liquid separator 352, expansion valve 7, and gas escape expansion valve 7*c* so that saturated liquid separated into two phases in gas-liquid separator 352 representing a low pressure region or refrigerant low in degree of dryness can flow into the evaporator. Whether refrigerant which flows on a downstream side is to be in a state of saturated liquid or two phases can be selected by opening and closing of gas escape expansion valve 7*c*. Since refrigerant is closer toward a single phase of liquid from two phases by setting saturated liquid or a low degree of dryness on the inlet side of the evaporator, two-phase refrigerant at port 200*c* (a side of flow-in of two-phase refrigerant in inlet header 4*b* in the first embodiment and inlet header 4*c* in the third embodiment) can more evenly be distributed.

Eighth Embodiment

Though the first to seventh embodiments describe only an example in which an outdoor unit includes first heat exchange portion 5*a* and second heat exchange portion 5*b*, the indoor unit may also include a similar circuit construction and may be formed such that the heat exchange portions are in parallel to each other during cooling and in series during heating. Since roles of the outdoor unit and the indoor unit are interchanged between cooling and heating, connection in series and connection in parallel are also interchanged.

FIG. 35 is a diagram showing a state of connection during cooling and heating when an outdoor heat exchanger and an indoor heat exchanger are divided. Referring to FIG. 35, during cooling, an outdoor heat exchanger serves as a condenser and heat exchangers resulting from division into two are connected in series. During cooling, the indoor heat exchanger serves as an evaporator and heat exchangers resulting from division into two are connected in parallel.

During heating, the outdoor heat exchanger serves as an evaporator and heat exchangers resulting from division into two are connected in parallel. During heating, the indoor heat exchanger serves as a condenser and heat exchangers resulting from division into two are connected in series.

Figure 36:
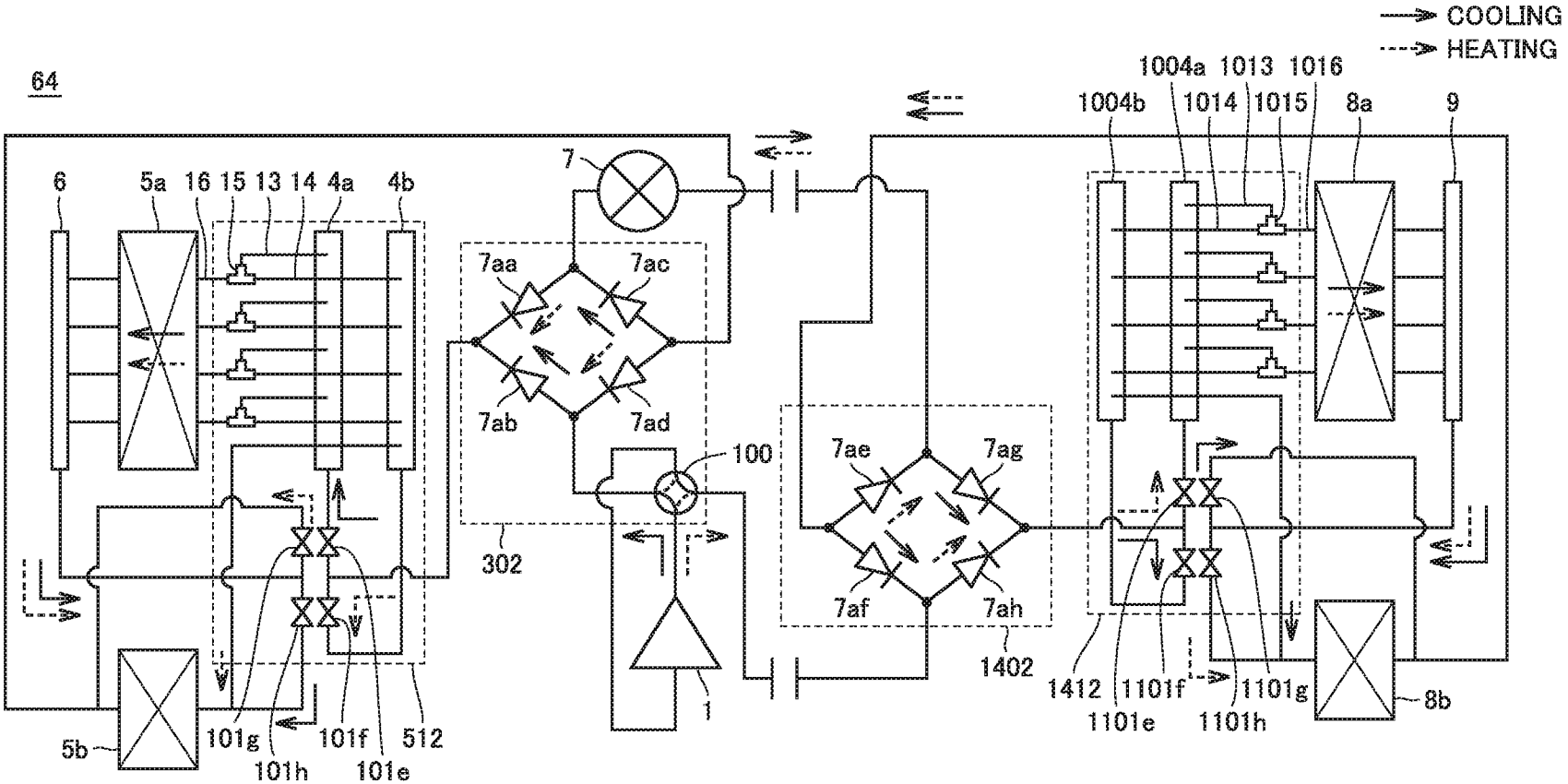
FIG. 36 is a diagram showing a first construction example of a refrigeration cycle apparatus according to an eighth embodiment.
Figure 37:
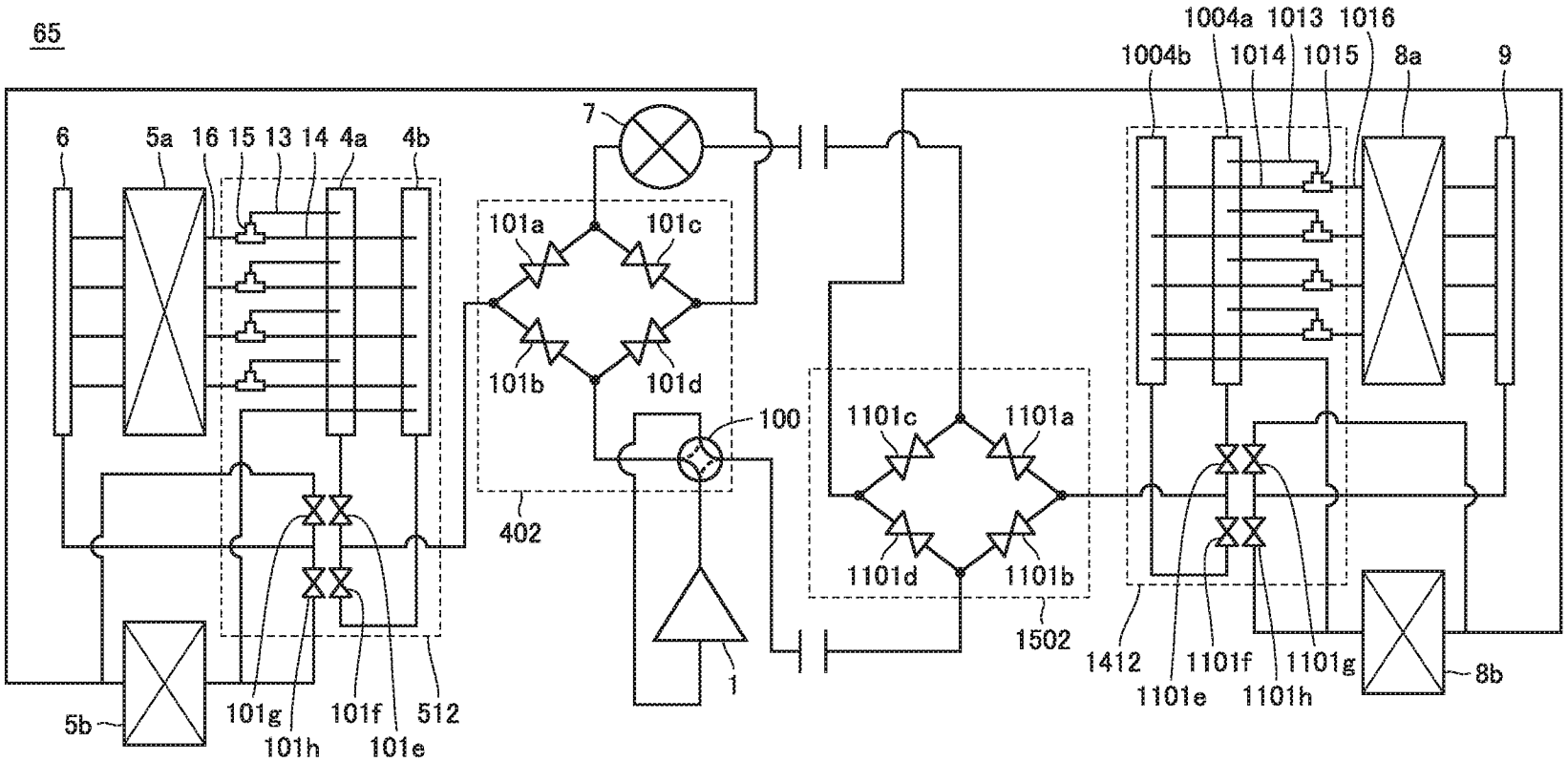
FIG. 37 is a diagram showing a second construction example of a refrigeration cycle apparatus according to the eighth embodiment.
Figure 38:
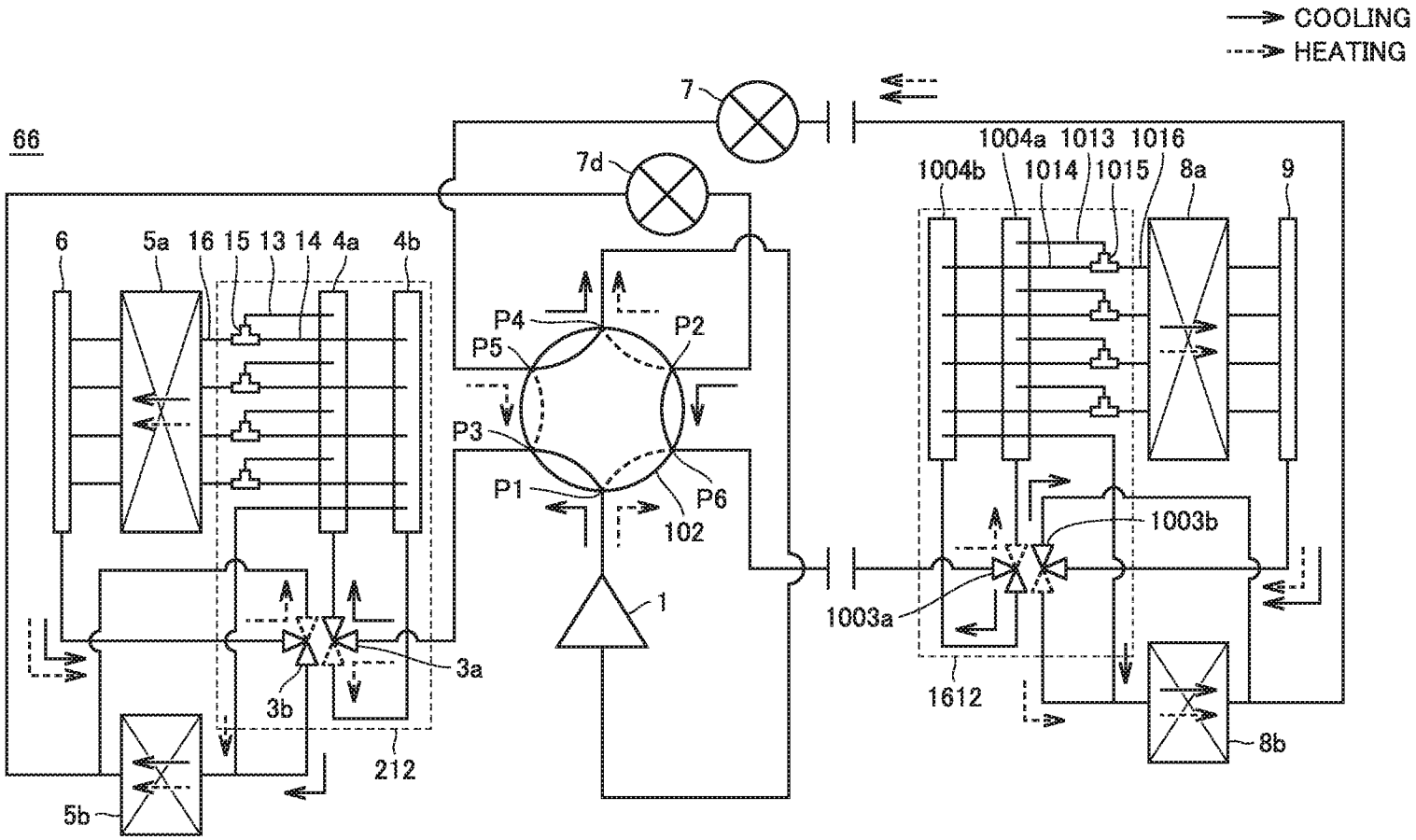
FIG. 38 is a diagram showing a third construction example of a refrigeration cycle apparatus according to the eighth embodiment.

FIG. 36 is a diagram showing a first construction example of a refrigeration cycle apparatus according to an eighth embodiment. FIG. 37 is a diagram showing a second construction example of a refrigeration cycle apparatus according to the eighth embodiment. FIG. 38 is a diagram showing a third construction example of a refrigeration cycle apparatus according to the eighth embodiment.

A refrigeration cycle apparatus 64 shown in FIG. 36 adopts a flow path switching feature also in an indoor unit, similarly to an outdoor unit in the construction of refrigeration cycle apparatus 55 shown in FIG. 19. Since the construction on the outdoor unit side is the same as in FIG. 19, description will not be provided.

The indoor unit of refrigeration cycle apparatus 64 includes heat exchange portions 8*a* and 8*b* resulting from division of the indoor heat exchanger, an outlet header 9, a flow path switching apparatus 1412 which switches connection of heat exchange portions 8*a* and 8*b*, and a flow path switching apparatus 1402 which switches a flow path such that a refrigerant outlet during heating and a refrigerant outlet during cooling are the same and a refrigerant inlet during heating and a refrigerant inlet during cooling are the same in the indoor unit.

Flow path switching apparatus 1412 includes inlet headers 1004*a* and 1004*b* and on-off valves 1101*e* to 1101*h*. Flow path switching apparatus 1402 includes check valves 7*ae*, 7*af*, 7*ag*, and 7*ah*.

An operation of refrigeration cycle apparatus 64 during cooling will now be described. During cooling, on-off valves 101*f*, 101*g*, 1101*e*, and 1101*h* are closed and on-off valves 101*e*, 101*h*, 1101*f*, and 1101*g* are opened. Four-way valve 100 is controlled to form a flow path as shown with a solid line. As compressor 1 is operated, refrigerant flows as shown with a solid arrow.

Refrigerant discharged from compressor 1 flows through four-way valve 100, check valve lab, and on-off valve 101*e*, flows into inlet header 4*a* of the outdoor heat exchanger, and is distributed to a plurality of flow paths in heat exchange portion 5*a*.

Refrigerant which has passed through heat exchange portion 5*a* flows to heat exchange portion 5*b* through outlet header 6 and on-off valve 101*h*, and thereafter reaches expansion valve 7 through check valve 7*ac*. Refrigerant decompressed by passage through expansion valve 7 reaches inlet header 1004*b* of an indoor heat exchange portion through check valve lag and on-off valve 1101*f*, and is distributed to a plurality of flow paths in heat exchange portion 8*a* and to heat exchange portion 8*b*. Refrigerant which has passed through heat exchange portion 8*a* flows through outlet header 9 and on-off valve 1101*g*, merges with refrigerant which has passed through heat exchange portion 8*b*, and thereafter returns to the inlet of compressor 1 through check valve 7*af* and four-way valve 100.

As described above, during cooling, as shown in FIG. 35, heat exchange portions 5*a* and 5*b* in the outdoor unit are connected in series and heat exchange portions 8*a* and 8*b* in the indoor unit are connected in parallel.

An operation of refrigeration cycle apparatus 64 during heating will now be described. During heating, on-off valves 101*f*, 101*g*, 1101*e*, and 1101*h* are opened and on-off valves 101*e*, 101*h*, 1101*f*, and 1101*g* are closed. Four-way valve 100 is controlled to form a flow path as shown with a dashed line. As compressor 1 is operated, refrigerant flows as shown with a dashed arrow.

Refrigerant discharged from compressor 1 flows into inlet header 1004*a* of the indoor heat exchanger through four-way valve 100, check valve 7*ah*, and on-off valve 1101*e*, and is distributed to a plurality of flow paths in heat exchange portion 8*a*.

Refrigerant which has passed through heat exchange portion 8*a* flows to heat exchange portion 8*b* through outlet header 9 and on-off valve 1101*h*, and thereafter reaches expansion valve 7 through check valve Tae. Refrigerant decompressed by passage through expansion valve 7 reaches inlet header 4*b* of an outdoor heat exchange portion through check valve 7*aa* and on-off valve 101*f*, and is distributed to the plurality of flow paths in heat exchange portion 5*a* and a flow path in heat exchange portion 5*b*. Refrigerant which has passed through heat exchange portion 5*a* flows through outlet header 6 and on-off valve 101*g*, merges with refrigerant which has passed through heat exchange portion 5*b*, and thereafter returns to the inlet of compressor 1 through check valve 7*ad* and four-way valve 100.

As described above, during heating, as shown in FIG. 35, heat exchange portions 5*a* and 5*b* in the outdoor unit are connected in parallel and heat exchange portions 8*a* and 8*b* in the indoor unit are connected in series.

A refrigeration cycle apparatus 65 shown in FIG. 37 includes flow path switching apparatus 402 instead of flow path switching apparatus 302 on the outdoor unit side in the construction of refrigeration cycle apparatus 64 shown in FIG. 36 and includes a flow path switching apparatus 1502 instead of flow path switching apparatus 1402 on the indoor unit side. Flow path switching apparatus 402 includes on-off valves 101*a* to 101*d*. Flow path switching apparatus 1502 includes on-off valves 1101*a* to 1101*d*. Since the construction is otherwise similar to that in FIG. 36, description will not be provided.

An operation of refrigeration cycle apparatus 65 during cooling will now be described. During cooling, on-off valves 101*f*, 101*g*, 1101*e*, and 1101*h* are closed and on-off valves 101*e*, 101*h*, 1101*f*, and 1101*g* are opened. Four-way valve 100 is controlled to form a flow path as shown with a solid line. Refrigeration cycle apparatus 65 is the same in the above as refrigeration cycle apparatus 64 in FIG. 36. In refrigeration cycle apparatus 65, however, opening and closing is further controlled in flow path switching apparatus 402 and flow path switching apparatus 1502. Specifically, during cooling, on-off valves 101*b*, 101*c*, 1101*a*, and 1101*d* are opened and on-off valves 101*a*, 101*d*, 1101*c*, and 1101*b* are closed. Since a flow of refrigerant is the same as shown with the solid arrow in FIG. 36, description will not be provided.

An operation of refrigeration cycle apparatus 65 during heating will now be described. During heating, on-off valves 101*f*, 101*g*, 1101*e*, and 1101*h* are opened and on-off valves 101*e*, 101*h*, 1101*f*, and 1101*g* are closed. Four-way valve 100 is controlled to form a flow path as shown with a dashed line. Refrigeration cycle apparatus 65 is the same in the above as refrigeration cycle apparatus 64 in FIG. 36. In refrigeration cycle apparatus 65, however, opening and closing is further controlled in flow path switching apparatus 402 and flow path switching apparatus 1502. Specifically, during heating, on-off valves 101*b*, 101*c*, 1101*a*, and 1101*d* are closed and on-off valves 101*a*, 101*d*, 1101*c*, and 1101*b* are opened. Since a flow of refrigerant is the same as shown with the dashed arrow in FIG. 36, description will not be provided.

A refrigeration cycle apparatus 66 shown in FIG. 38 is slightly modified in construction of the outdoor unit as compared with the construction of refrigeration cycle apparatus 52 shown in FIG. 4 and adopts a flow path switching feature also in the indoor unit. The outdoor unit side is configured such that a connection destination of port P2 of the six-way valve and a connection destination of port P4 thereof are interchanged and an expansion valve 7*d* is added in the construction of refrigeration cycle apparatus 52. Since the construction on the outdoor unit side is otherwise the same as in FIG. 4, description will not be provided.

The indoor unit of refrigeration cycle apparatus 66 includes heat exchange portions 8*a* and 8*b* resulting from division of an indoor heat exchanger, outlet header 9, and a flow path switching apparatus 1612 which switches connection of heat exchange portions 8*a* and 8*b*.

Flow path switching apparatus 1612 includes inlet headers 1004*a* and 1004*b* and switch valves 1003*a* and 1003*b*.

An operation of refrigeration cycle apparatus 66 during cooling will now be described. During cooling, the six-way valve is controlled to form a flow path as shown with a solid line. Switch valves 3*a*, 3*b*, 1003*a*, and 1003*b* switch a flow path as shown with a solid line. Expansion valve 7 is fully opened and a position of expansion valve 7*d* is controlled as a common expansion valve. As compressor 1 is operated, refrigerant flows as shown with a solid arrow.

Refrigerant discharged from compressor 1 flows into inlet header 4*a* of the outdoor heat exchanger through ports P1 and P3 of six-way valve 102 and switch valve 3*a* and is distributed to a plurality of flow paths in heat exchange portion 5*a*.

Refrigerant which has passed through heat exchange portion 5*a* passes through heat exchange portion 5*b* through outlet header 6 and switch valve 3*b* and thereafter reaches expansion valve 7*d*. Refrigerant decompressed by passage through expansion valve 7*d* reaches inlet header 1004*b* of the indoor heat exchange portion through ports P2 and P6 of six-way valve 102 and switch valve 1003*a*, and is distributed to a plurality of flow paths in heat exchange portion 8*a* and to heat exchange portion 8*b*. Refrigerant which has passed through heat exchange portion 8*a* flows through outlet header 9 and switch valve 1003*b*, merges with refrigerant which has passed through heat exchange portion 8*b*, and thereafter returns to the inlet of compressor 1 through fully opened expansion valve 7 and ports P5 and P4 of six-way valve 102.

As described above, during cooling, as shown in FIG. 35, heat exchange portions 5*a* and 5*b* in the outdoor unit are connected in series and heat exchange portions 8*a* and 8*b* in the indoor unit are connected in parallel.

An operation of refrigeration cycle apparatus 66 during heating will now be described. During heating, six-way valve 102 is controlled to form a flow path as shown with a dashed line. Switch valves 3*a*, 3*b*, 1003*a*, and 1003*b* switch a flow path as shown with a dashed line. Expansion valve 7*d* is fully opened and a position of expansion valve 7 is controlled as a common expansion valve. As compressor 1 is operated, refrigerant flows as shown with a dashed arrow.

Refrigerant discharged from compressor 1 flows into inlet header 1004*a* of the indoor heat exchanger through ports P1 and P6 of six-way valve 102 and switch valve 1003*a*, and is distributed to the plurality of flow paths in heat exchange portion 8*a*.

Refrigerant which has passed through heat exchange portion 8*a* flows to heat exchange portion 8*b* through outlet header 9 and switch valve 1003*b*, and thereafter reaches expansion valve 7. Refrigerant decompressed by passage through expansion valve 7 reaches inlet header 4*b* of the outdoor heat exchange portion through ports P5 and P3 of six-way valve 102 and first flow path switch valve 3*a*, and is distributed to the plurality of flow paths in heat exchange portion 5*a* and the flow path in heat exchange portion 5*b*. Refrigerant which has passed through heat exchange portion 5*a* flows through outlet header 6 and switch valve 3*b*, merges with refrigerant which has passed through heat exchange portion 5*b*, and thereafter returns to the inlet of the compressor through fully opened expansion valve 7*d* and ports P2 and P4 of the six-way valve.

As described above, during heating, as shown in FIG. 35, heat exchange portions 5*a* and 5*b* in the outdoor unit are connected in parallel and heat exchange portions 8*a* and 8*b* in the indoor unit are connected in series.

According to the refrigeration cycle apparatus in the eighth embodiment, each of the outdoor unit and the indoor unit is formed such that the first heat exchange portion is greater in heat exchanger capacity and number of flow paths than the second heat exchange portion so that flow paths in optimal number can be formed during cooling and heating. Thus, in a liquid phase region where pressure loss is less, heat transferability can be improved while pressure loss in the gas region and the two-phase region is lessened.

By making first heat exchange portion 5*a* greater in size than second heat exchange portion 5*b* in the outdoor unit, a ratio of a liquid phase region of refrigerant which flows into second heat exchange portion 5*b* during cooling is higher and a flow velocity can be lower.

By making first heat exchange portion 8*a* greater in size than second heat exchange portion 8*b* in the indoor unit, a ratio of a liquid phase region of refrigerant which flows into second heat exchange portion 8*b* during heating is higher and a flow velocity can be lower.

By evenly distributing refrigerant with a distribution apparatus being changed between cooling and heating in each of the outdoor unit and the indoor unit, heat transferability can be improved. With improvement in heat transferability, an operation pressure in the refrigeration cycle can be lowered on the high-pressure side and can increase on the low-pressure side. An operation pressure in the refrigeration cycle is lowered on the high-pressure side and increases on the low-pressure side so that input at the compressor is lowered and performance of the refrigeration cycle can be improved.

A construction other than the construction on the indoor unit side shown in FIGS. 36 to 38 may be applicable. For example, any of flow path switching apparatuses 12, 112, 212, 512, 612, 712, 812, 912, 1012, 1412, and 1612 described in the first to seventh embodiments may be adopted as the flow path switching apparatus on the indoor unit side in the eighth embodiment. Any of the constructions described in the first to seventh embodiments may be adopted also for the construction on the outdoor unit side.

It should be understood that the embodiments disclosed herein are illustrative and non-restrictive in every respect. The scope of the present invention is defined by the terms of the claims rather than the description of the embodiments above and is intended to include any modifications within the scope and meaning equivalent to the terms of the claims.

REFERENCE SIGNS LIST

1 compressor; 2, 12, 112, 212, 302, 402, 512, 612, 712, 812, 912, 1012, 1402, 1412, 1502, 1612 flow path switching apparatus; 3 switch portion; 3*a* to 3*d*, 1003*a*, 1003*b* switch valve; 3*ca* to 3*cf*, 200*a* to 200*f*, P1 to P6, P11 to P15 port; 4*a*, 4*b*, 4*c*, 1004*a*, 1004*b* inlet header; 4*b*0 distributor; 4*ca* gas-side region; 4*cb* two-phase-side region; 4*cx* header casing; 4*cy* partition plate; 5 first heat exchange apparatus; 5*a*, 5*b*, 8*a*, 8*b* heat exchange portion; 6, 9 outlet header; 7, 7*a* to 7*d* expansion valve; 7*aa* to 7*ah*, 7*ba* to 7*bd*, 7*ca* to 7*ce* check valve; 8 second heat exchange apparatus; 13, 14, 17, 18 pipe; 15, 19 merge portion; 30 control device; 50 to 66 refrigeration cycle apparatus; 100 four-way valve; 101*a* to 101*h*, 101*aa* to 101*ad*, 101*ba* to 101*be*, 1101*a* to 1101*h* on-off valve; 102 six-way valve; 103, 201 coil; 104 plunger; 105, 203*a*, 203*b* valve disc; 106, 204 valve seat; 202 motor; 350 high- and low-pressure heat exchanger; 351 receiver; 352 gas-liquid separator

The invention claimed is:

1. A refrigeration cycle apparatus comprising:

a compressor;

a first heat exchange apparatus;

an expansion valve;

a second heat exchange apparatus; and a first flow path switching apparatus configured to (a) change a flow path such that an order of circulation of refrigerant discharged from the compressor is switched between a first order and a second order, and (b) switch a flow path such that refrigerant flows into a refrigerant inlet of the first heat exchange apparatus and refrigerant flows out of a refrigerant outlet of the first heat exchange apparatus when the order is either the first order or the second order, the first order being an order of circulation of refrigerant from the compressor, the first heat exchange apparatus, the expansion valve, and the second heat exchange apparatus, the second order being an order of circulation of refrigerant from the compressor, the second heat exchange apparatus, the expansion valve, and the first heat exchange apparatus, the first heat exchange apparatus comprising a first heat exchange portion, a second heat exchange portion, and a second flow path switching apparatus configured to switch the flow path such that, (a) when the order of circulation of the refrigerant is the first order, the refrigerant successively flows to the first heat exchange portion and the second heat exchange portion, and (b) when the order of circulation of the refrigerant is the second order, the refrigerant flows in parallel to the first heat exchange portion and the second heat exchange portion, the second flow path switching apparatus comprising a first distribution apparatus configured to distribute the refrigerant to a plurality of refrigerant flow paths in the first heat exchange portion, a second distribution apparatus configured to distribute the refrigerant to the plurality of refrigerant flow paths in the first heat exchange portion and to the second heat exchange portion, and a switch portion configured, in accordance with whether the order of circulation of the refrigerant is the first order or the second order, to (a) switch connection of the refrigerant inlet of the first heat exchange apparatus to the first distribution apparatus or the second distribution apparatus and (b) switch between passing through the second heat exchange portion, of refrigerant which flows out of the refrigerant outlet of the first heat exchange portion and merging with refrigerant which flows out of a refrigerant outlet of the second heat exchange portion.

2. The refrigeration cycle apparatus according to claim 1, wherein the switch portion comprises a first switch valve configured to pass refrigerant to the first distribution apparatus when the order of circulation of the refrigerant is the first order, and to pass refrigerant to the second distribution apparatus when the order of circulation of the refrigerant is the second order, and a second switch valve configured to connect the refrigerant outlet of the first heat exchange portion to a refrigerant inlet of the second heat exchange portion when the order of circulation of the refrigerant is the first order, and to merge the refrigerant outlet of the first heat exchange portion with the refrigerant outlet of the second heat exchange portion when the order of circulation of the refrigerant is the second order.

3. The refrigeration cycle apparatus according to claim 1, wherein the first distribution apparatus is implemented by a header, and the second distribution apparatus is implemented by a distributor.

4. The refrigeration cycle apparatus according to claim 1, wherein the first distribution apparatus is implemented by a first inlet header, and the second distribution apparatus is implemented by a second inlet header.

5. The refrigeration cycle apparatus according to claim 1, wherein the second flow path switching apparatus further comprises a first pipe connected to an exit of the first distribution apparatus, a first check valve provided in the first pipe, a second pipe connected to an exit of the second distribution apparatus, a second check valve provided in the second pipe, and a third pipe which sends refrigerant to the first heat exchange portion after merge of the first pipe and the second pipe.

6. The refrigeration cycle apparatus according to claim 1, wherein the second flow path switching apparatus further comprises a first pipe connected to an exit of the first distribution apparatus, a first on-off valve provided in the first pipe, a second pipe connected to an exit of the second distribution apparatus, a second on-off valve provided in the second pipe, and a third pipe which sends refrigerant to the first heat exchange portion after merge of the first pipe and the second pipe.

7. The refrigeration cycle apparatus according to claim 1, wherein the first distribution apparatus and the second distribution apparatus are implemented by an inlet header of which inner volume is divided into two sections by a partition plate.

8. The refrigeration cycle apparatus according to claim 7, wherein the partition plate is configured to divide the inlet header such that a portion corresponding to the first distribution apparatus occupies 50% or more of the volume.

9. The refrigeration cycle apparatus according to claim 1, wherein the switch portion comprises a shaft, a coil configured to move the shaft in a direction along the shaft, a plurality of valve discs configured to move in coordination with movement of the shaft, and a valve main body in which a plurality of flow paths switched by the plurality of valve discs are formed.

10. The refrigeration cycle apparatus according to claim 1, wherein the switch portion comprises a shaft, a coil configured to move the shaft in a direction along the shaft, a motor configured to rotate the shaft on an axis of the shaft, a first valve disc configured to be moved in coordination with movement of the shaft in the direction along the shaft, a second valve disc configured to be moved in coordination with rotation of the shaft, and a valve main body in which a plurality of flow paths switched by the first valve disc and the second valve disc are formed.

11. The refrigeration cycle apparatus according to claim 1, wherein the first heat exchange portion and the second heat exchange portion are configured such that the first heat exchange portion is higher in heat exchange capacity than the second heat exchange portion and the first heat exchange portion is greater in number of refrigerant flow paths through which refrigerant flows in parallel than the second heat exchange portion.

12. The refrigeration cycle apparatus according to claim 1, wherein the second flow path switching apparatus further comprises a first pipe connected to an exit of the first distribution apparatus, a second pipe connected to an exit of the second distribution apparatus, and a third pipe which sends refrigerant to the first heat exchange portion after merge of the first pipe and the second pipe, and when a portion of merge between the first pipe and the second pipe is viewed in a direction along the third pipe, an angle of merge of the first pipe with the second pipe is greater than 90° and not greater than 180° or not smaller than −180° and smaller than −90°, with a direction of gravity being defined as 0°.

13. The refrigeration cycle apparatus according to claim 1, wherein the second flow path switching apparatus further comprises a first pipe connected to an exit of the first distribution apparatus, a second pipe connected to an exit of the second distribution apparatus, and a third pipe which sends refrigerant to the first heat exchange portion after merge of the first pipe and the second pipe, and the first pipe is greater in diameter than the second pipe, and the first pipe is shorter in length than the second pipe.

14. The refrigeration cycle apparatus according to claim 1, wherein the second flow path switching apparatus further comprises a first pipe connected to an exit of the switch portion, a second pipe connected to an exit of the second distribution apparatus, and a third pipe which sends refrigerant to the first heat exchange portion after merge of the first pipe and the second pipe, the first pipe is greater in diameter than the second pipe, and the first pipe is shorter in length than the second pipe.

15. The refrigeration cycle apparatus according to claim 1, wherein the second heat exchange apparatus comprises a third heat exchange portion, a fourth heat exchange portion, and a third flow path switching apparatus configured to switch the flow path such that (a) refrigerant successively flows to the third heat exchange portion and the fourth heat exchange portion when the order of circulation of the refrigerant is the second order and (b) the refrigerant flows in parallel to the third heat exchange portion and the fourth heat exchange portion when the order of circulation of the refrigerant is the first order, and the third flow path switching apparatus comprises a third distribution apparatus configured to distribute the refrigerant to a plurality of refrigerant flow paths in the third heat exchange portion, a fourth distribution apparatus configured to distribute the refrigerant to the plurality of refrigerant flow paths in the third heat exchange portion and to the fourth heat exchange portion, and a switch portion configured, in accordance with whether the order of circulation of the refrigerant is the first order or the second order, to (a) switch connection of the refrigerant inlet of the first heat exchange apparatus to the first distribution apparatus or the second distribution apparatus and (b) switch between passing through the fourth heat exchange portion, of refrigerant which flows out of a refrigerant outlet of the third heat exchange portion and merging with refrigerant which flows out of a refrigerant outlet of the fourth heat exchange portion.

* * * * *